US010605513B2

(12) United States Patent
Jeong

(10) Patent No.: US 10,605,513 B2
(45) Date of Patent: Mar. 31, 2020

(54) ICE MAKER WITH ADJUSTING APPARATUS FOR WATER SUPPLY

(71) Applicant: DR TECH CO., LTD., Gwangju (KR)

(72) Inventor: Byung Wook Jeong, Gwangju (KR)

( * ) Notice: Subject to any disclaimer, the term of this patent is extended or adjusted under 35 U.S.C. 154(b) by 44 days.

(21) Appl. No.: 15/571,207

(22) PCT Filed: Jun. 26, 2017

(86) PCT No.: PCT/KR2017/006702

§ 371 (c)(1),
(2) Date: Nov. 1, 2017

(87) PCT Pub. No.: WO2019/004489

PCT Pub. Date: Jan. 3, 2019

(65) Prior Publication Data

US 2018/0372389 A1 Dec. 27, 2018

(30) Foreign Application Priority Data

Jun. 26, 2017 (KR) ..... 10-2017-0080243

(51) Int. Cl.

| | |
|---|---|
| ***F25C 1/25*** | (2018.01) |
| ***F25D 29/00*** | (2006.01) |
| ***F25C 5/02*** | (2006.01) |

(52) U.S. Cl.

CPC ..... *F25C 1/25* (2018.01); *F25C 5/02* (2013.01); *F25D 29/005* (2013.01); *F25C 2400/14* (2013.01); *F25C 2600/02* (2013.01)

(58) Field of Classification Search

CPC ..... F25C 1/25; F25C 5/02; F25C 2600/02; F25D 29/005

See application file for complete search history.

(56) References Cited

U.S. PATENT DOCUMENTS 2,796,741 A * 6/1957 Barton ..... F25C 1/04 62/137
3,612,800 A * 10/1971 Slopa ..... H01H 19/623 200/500
3,649,781 A * 3/1972 Johnsen ..... G04F 3/06 200/33 B (Continued)

FOREIGN PATENT DOCUMENTS

KR 20070021922 A 2/2007
KR 101304299 B1 9/2013
KR 101450595 B1 10/2014

*Primary Examiner* — Kun Kai Ma

(74) *Attorney, Agent, or Firm* — Faegre Drinker Biddle & Reath LLP

(57) ABSTRACT

The present invention relates to an ice maker, and more particularly, to an ice maker with an adjusting apparatus for water supply, which can easily change a position of an adjusting micro switch for adjusting a water supply time, thereby conveniently and accurately adjusting the water supply time and simplifying the configuration of the ice maker, the ice maker including a driver that drives an operation cam, an operation lever driven in contact with the operation cam, a plate-shaped bracket having the operation lever installed therein and provided inside an inner housing, a holder movably installed in the bracket and having the adjusting micro switch fixed thereto, and a control screw penetrating the inner housing and threaded on the holder.

10 Claims, 19 Drawing Sheets

(56) References Cited

U.S. PATENT DOCUMENTS 3,727,427 A * 4/1973 Eyman, Jr. ..... F25B 49/02 249/129
4,746,780 A 5/1988 Resh
4,835,978 A * 6/1989 Cole ..... F25C 1/04 62/137
4,866,948 A * 9/1989 Cole ..... F25C 1/04 62/233
5,187,948 A * 2/1993 Frohbieter ..... F25C 1/08 62/351
5,213,205 A * 5/1993 Laubach ..... H01H 1/5855 200/293
5,596,182 A * 1/1997 Edwards ..... F25C 1/04 200/38 R
5,881,563 A * 3/1999 Lee ..... F25C 1/04 62/353
5,970,725 A * 10/1999 Lee ..... F25C 1/04 62/137
7,619,172 B2 11/2009 Maehara et al.
2008/0053779 A1* 3/2008 Higashitani ..... F16D 7/021 192/54.1
2008/0053812 A1* 3/2008 Higashitani ..... F25C 5/187 200/569
2008/0173039 A1* 7/2008 Higashitani ..... F25C 1/22 62/349
2008/0237000 A1* 10/2008 Maehara ..... F25D 29/005 200/19.21
2009/0255282 A1* 10/2009 Amonett ..... F25C 1/00 62/137
2010/0319385 A1* 12/2010 Hashimoto ..... F16H 25/16 62/344
2011/0000233 A1* 1/2011 Rybaski ..... F25C 1/04 62/66
2012/0017512 A1* 1/2012 Lee ..... E05F 15/614 49/349
2012/0186288 A1* 7/2012 Hapke ..... F25C 5/187 62/137
2012/0297802 A1* 11/2012 Tanaka ..... F25C 5/187 62/129

* cited by examiner

ICE MAKER WITH ADJUSTING APPARATUS FOR WATER SUPPLY

TECHNICAL FIELD

The present invention relates to an ice maker, and more particularly, to an ice maker, and more particularly, to an ice maker with an adjusting apparatus for water supply, which can easily change a position of an adjusting micro switch for adjusting a water supply time, thereby conveniently and accurately adjusting the water supply time and simplifying the configuration of the ice maker, the ice maker including a driver that drives an operation cam, an operation lever driven in contact with the operation cam, a plate-shaped bracket having the operation lever installed therein and provided inside an inner housing, a holder movably installed in the bracket and having the adjusting micro switch fixed thereto, and a control screw penetrating the inner housing and threaded on the holder.

BACKGROUND ART

In general, an ice maker is an appliance for making ice in a low temperature storage unit, such as a refrigerator.

As illustrated in FIG. 1, a general ice maker includes a shaft SH driven by a driver D and a blade B provided on the shaft SH to scoop up ice.

The driver D is installed inside a housing H, and the housing H includes an inner housing H1 installed at a side of the shaft SH and an outer housing H2 installed to cover the inner housing H1.

Water is supplied to an ice tray IT and then cooled to make ice. As the shaft SH is rotated by actuating the driver D, an ejector E rotates and performs an ice-separating operation.

A water supply unit W supplies water to the ice tray IT and an amount of water supplied is controlled by adjusting an operating time of a supply valve (not shown).

As illustrated in FIG. 2, the supply valve is operated to supply water while an operation terminal MC1-1 of an adjusting micro switch MC1 is pressed. If the operation terminal MC1-1 is no longer pressed to return its original position, the supply valve blocks water supply.

The adjusting micro switch MC1 is installed in a bracket 4 provided in the inner housing H1 or the outer housing H2 (see FIG. 1).

One of existing techniques for adjusting the operating time of the supply valve is to push or pull a control bar 2 by rotating a control screw 3, as illustrated in FIG. 2. As the control bar 2 is moved, the adjusting micro switch MC1 rotates around its one position.

For example, when the adjusting micro switch MC1 rotates around a position 1 (P1), a distance between the operation terminal MC1-1 and a control cam C may vary. Therefore, a time in which the operation terminal MC1-1 is pressed may change according to eccentric rotation of the control cam C, thereby adjusting the water supply time.

However, the following problems arise in the aforementioned existing technique.

That is to say, in order to adjust a water supply time, a user may move the control bar 2 by rotating the control screw 3. Here, in order to adjust the water supply time as desired by the user, the control bar 2 should be moved by an accurate distance. To this end, it is necessary to accurately control rotational displacement of the control screw 3.

However, it is quite difficult for the user to accurately control a rotation amount of the control screw 3. In addition, in view of characteristics of the adjusting micro switch MC1, even a slight deviation in the rotation amount of the control screw 3 may undesirably make a considerable difference in the operating time of the operation terminal MC1-1.

Further, in the aforementioned conventional ice maker, the adjusting micro switch MC1 is configured to rotate around a predetermined position, the rotation center of the micro switch MC1 may be changed according to use, making it difficult to accurately adjust the water supply time, as desired by the user.

In order to overcome the drawbacks, the applicant of the present invention proposed a lever-type water supply adjusting apparatus and method for an ice maker, which can conveniently and accurately adjust a water supply time through movement of the adjusting micro switch, the lever-type water supply adjusting apparatus including an operation lever ascending and descending in contact with an operation groove of a control cam, a micro switch operated by the operation lever and a case movably accommodating the micro switch (Korean Patent Registration No. 10-1730013).

The applicant of the present invention also proposed a water supply adjusting apparatus and method for an ice maker, which can accurately adjust a user's desired water supply time by bringing a pressing bar actuating an adjusting micro switch into contact with a control cam, forming an operating groove in the control cam, varying a width of the operating groove and adjusting a height of the pressing bar, thereby accurately adjusting the user's desired water supply time (Korean Patent Registration No. 10-1730017).

In Korean Patent Registration No. 10-1730017 disclosed by the applicant of the present invention, the water supply is controlled by adjusting the height of the pressing bar while varying the width of the operating groove. Thus, constructions of the operating groove and the pressing bar may become complex.

Additionally, in Korean Patent Registration No. 10-1730013 disclosed by the applicant of the present invention, in order to change a position of an adjusting micro switch, a user should transfer the adjusting micro switch in person after deconstructing a housing, suggesting that lots of time and efforts are required in adjusting the water supply time.

Meanwhile, the aforementioned ice maker and techniques related to water supply are widely known in the art, which are particularly exemplified and described in detail in the following cited references, and descriptions and illustrations thereof will not be given.

DISCLOSURE OF INVENTION

Technical Problems

The present invention is contemplated to solve the above problems in the prior art and the present invention provides an ice maker with an adjusting apparatus for water supply, which can easily change a position of an adjusting micro switch for adjusting a water supply time, thereby conveniently and accurately adjusting the water supply time and simplifying the configuration of the ice maker, the ice maker including a driver that drives an operation cam, an operation lever driven in contact with the operation cam, a plate-shaped bracket having the operation lever installed therein and provided inside an inner housing, a holder movably installed in the bracket and having the adjusting micro switch fixed thereto, and a control screw penetrating the inner housing and threaded on the holder.

However, the objects of the present invention are not limited to the objects stated above and, although not stated, other objects based on the following means or specific construction of a preferred embodiment will be apparently appreciated by those skilled in the art from the description of the preferred embodiment.

Solutions to Problems

To achieve the above object, there is provided an ice maker with a water supply adjusting apparatus, the ice maker including a driver that drives an operation cam, and a water supply adjusting apparatus interlocked with the operation cam and adjusting an operating time of a micro switch, wherein the water supply adjusting apparatus includes an operation lever driven in contact with the operation cam, a plate-shaped bracket having the operation lever installed therein and provided inside an inner housing, a holder movably installed in the bracket and having the adjusting micro switch fixed thereto, and a control screw penetrating the inner housing and having one side exposed to the outside of the inner housing and the other side threaded on the holder. Here, the holder includes a plate-shaped holder body having the adjusting micro switch installed therein and movably installed on the bracket, and a screw inserting portion protruding on a bottom surface of the holder body and threaded with the control screw. In addition, the bracket includes a plate-shaped bracket body provided in the inner housing and a screw mounting groove concavely formed in the bracket body to allow the screw inserting portion and the control screw to be placed therein. The screw inserting portion has a ring shape and is elongated in a direction in which the holder is moved, and the screw mounting groove is formed in an arc having a predetermined curvature and elongated in a direction in which the holder is moved, so that the screw inserting portion moves in a state in which it is accommodated in the screw mounting groove.

Here, the holder may further include an insertion pin formed on the holder body and penetrating a fixing hole of the adjusting micro switch, a clamp formed on a top surface of the holder body in an inverted L shape to come into contact with side and top surfaces of the adjusting micro switch, and an insertion blade protruding on a side surface parallel with a direction in which the holder body is moved. The bracket may further include a guide formed in the bracket body to be combined with the insertion blade, the guide having a vertical portion upwardly protruding on the bracket body and a horizontal portion horizontally bent at an end of the vertical portion, the vertical portion and the horizontal portion extending in the direction in which the holder body is moved, and the insertion blade being in contact with a bottom surface of the horizontal portion and a side surface of the vertical portion.

An opening portion may be formed in the bracket body corresponding to the bottom surface of the horizontal portion.

The control screw may include a screw portion threaded with the screw inserting portion, a head portion provided at one-side end of the screw portion to be combined with an operation tool, and a pair of lock valves formed at an exterior side of the screw portion in a plate shape. In addition; the inner housing may further include an inner housing body being hollow and having an opened side surface disposed at a side of the outer housing, a penetration hole formed in one side of the inner housing body, and a pocket formed on an internal surface of the inner housing body having the penetration hole, the pocket being shaped of a hollow box having an open top surface, one of the pair of lock valves, which is positioned outside the inner housing, being mounted in an inner space of the pocket, and housing mounting being formed on top surfaces of inner and outer partitions of the pocket, respectively, to allow the outer surface of the screw portion disposed between the pair of lock valves and the head portion to be mounted therein.

The driver may include a drive cam that drives an ice-separating shaft and interlocked with the operation cam, a drive actuator that actuates the drive cam by providing a one-directional rotating power, and a one-way clutch provided between the drive cam and the drive actuator. Here, the one-way clutch includes a driving gear interlocked with the drive cam, one or more idling gears engaged with an internally toothed portion of the driving gear, and a cap inserted into the interior of the internally toothed portion and interlocked with the drive actuator to intermittently effectuate rotation of the one or more idling gears. Here, when the cap is rotated by the drive actuator in one direction, a portion of the cap comes into contact with each of the one or more idling gears to interrupt the rotation of the idling gear and to allow power to be transmitted from the drive actuator to the drive cam, and when the drive cam is rotated by an external force in the opposite direction, the idling gear is engaged with the internally toothed portion and then rotated to block power transmission between the drive actuator and the drive cam.

The cap may include a cap body shaped of a plate and interlocked with the drive actuator, and an intermittently power-transmitting portion protruding from the cap body and inserted into the interior of the internally toothed portion of the driving gear. Here, the intermittently power-transmitting portion includes a cylindrical main body, a cutout portion formed by partially cutting out one side of the main body of the intermittently power-transmitting portion in a radial direction to allow the idling gear to be placed therein, and a wedge portion and an arc portion formed at places where opposite ends of the cutout portion and the main body meet, respectively. Here, the wedge portion is bent at a predetermined angle to be inserted between teeth of the idling gear according to the rotation of the cap body, and a side surface of the arc portion is curved with a predetermined curvature to be spaced a predetermined distance apart from the idling gear so as not to come into contact with the idling gear even when the cap body is rotated. When the intermittently power-transmitting portion is rotated by the drive actuator in one direction, the wedge portion is formed at one side surface of the intermittently power-transmitting portion, the one side surface approaching the idling gear, and the arc portion is formed at the other side surface of the intermittently power-transmitting portion, the other side surface getting far away from the idling gear. In addition, a mounting groove may be formed in a portion of the cap body corresponding to a bottom of the cutout portion to allow a portion of the idling gear to be inserted into the mounting groove.

The main body of the intermittently power-transmitting portion may include a plate-shaped insertion groove concavely formed therein, the cap body may include a locking groove concavely formed at its side surface being opposite to the main body, the locking groove including a penetration hole formed in its bottom, so that the insertion groove and the locking groove are communicated with each other. The drive actuator may include a driving plate shaped of a plate shape and rotating and a protrusion bar formed at an ending portion of the driving plate, the driving plate being inserted into the insertion groove to be locked, and the protrusion bar being inserted into the penetration hole.

The driving gear may include a gear body shaped of a hollow cylinder and having a cap side surface opened and an opposite side surface closed and having a penetrating portion formed thereat, an internally toothed portion formed on an inner surface of the gear body, an externally toothed portion formed on an outer surface of the gear body, and a groove portion formed around the penetrating portion in the inner surface of the gear body in a circumferential direction to allow the idling gear to be mounted thereon.

The idling gear may include a bar-shaped shaft and a toothed portion formed around the shaft to be engaged with the internally toothed portion of the driving gear, the shaft having one side inserted into the groove portion of the driving gear and the other side inserted into the mounting groove of the cap.

Here, the mounting groove may be formed in a circumferential direction of the cap by a predetermined length to allow the idling gear to revolve.

Additional features and advantages of the present invention will become readily apparent from the following detailed description in conjunction with the accompanying drawings.

Before describing the invention, it is noted that the terms or words used in the description and claims are not to be interpreted by their typical or dictionary meanings, but their meanings and concepts should be interpreted in conformity with the technical idea of the invention, based on the principle that the inventor may properly define the concepts of the terms so as to explain the invention in the best manner. The technical terms used herein are for the purpose of describing a particular embodiment only and are not intended to be limiting of the invention.

Advantageous Effects of Invention

As described above, according to the present invention, the water supply time can be more conveniently and accurately adjusted than the prior art and the configuration of the ice maker can be simplified.

DISCLOSURE OF THE INVENTION

Detailed Description of the Invention

Hereinafter, an exemplary embodiment of the present invention will be described with reference to accompanying drawings. It is noted that the drawings may be exaggerated in thickness of lines or sizes of components for clarity and convenience of explanation.

In addition, terms used herein are defined in consideration of functions in the present invention and can be changed according to the custom or intention of users or operators. Thus, definition of such terms should be determined according to overall disclosures set forth herein.

Furthermore, the present invention is not limited to the following embodiment, which is provided only for illustration, and several modifications and changes can be made to this embodiment including components that fall within the technical scope and spirit throughout the specification of the present invention and that can be substituted as equivalents of the components defined in claims.

Figure 3:
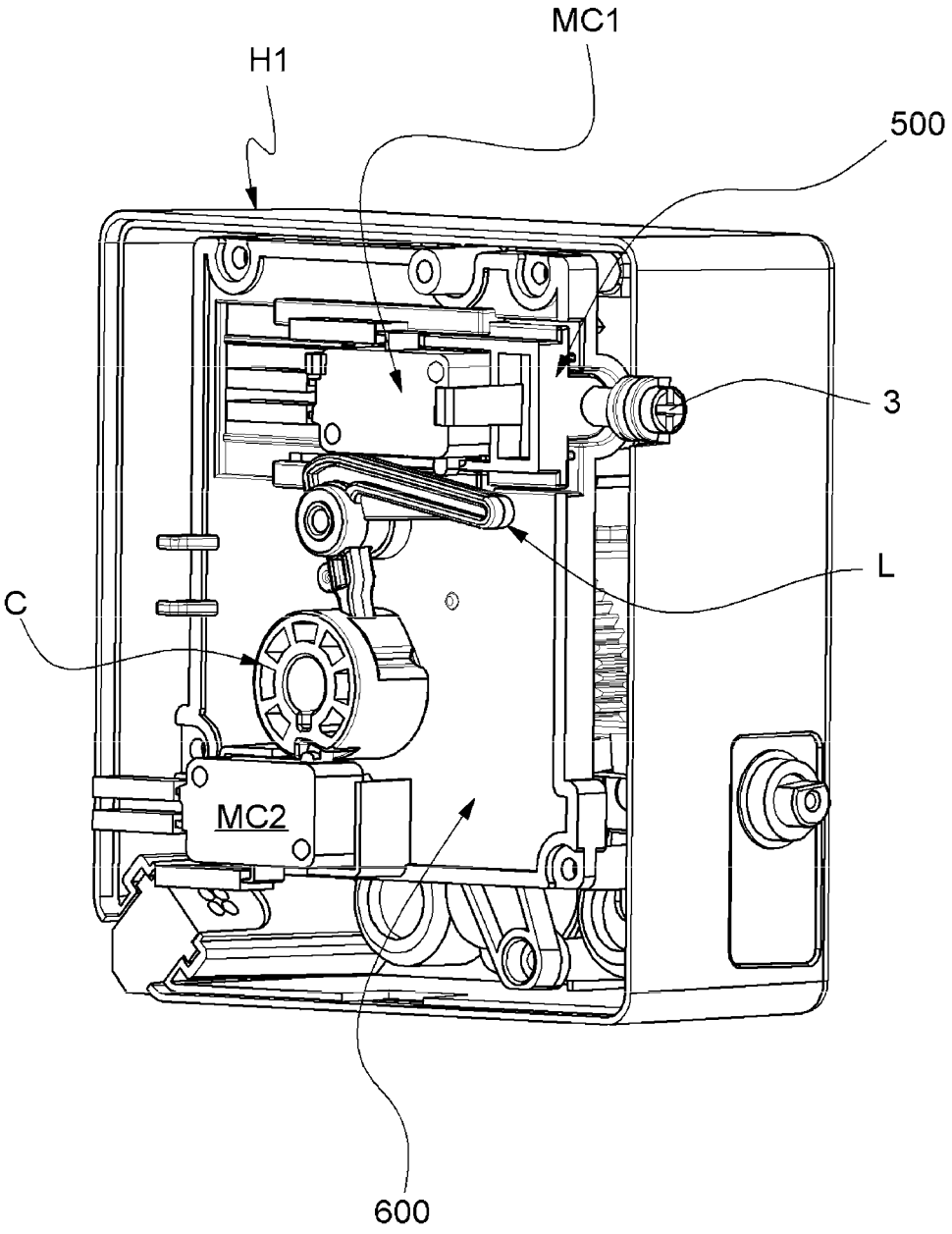
FIG. 3 is a perspective view illustrating a water supply adjusting apparatus of an ice maker according to an embodiment of the present invention.
Figure 4:
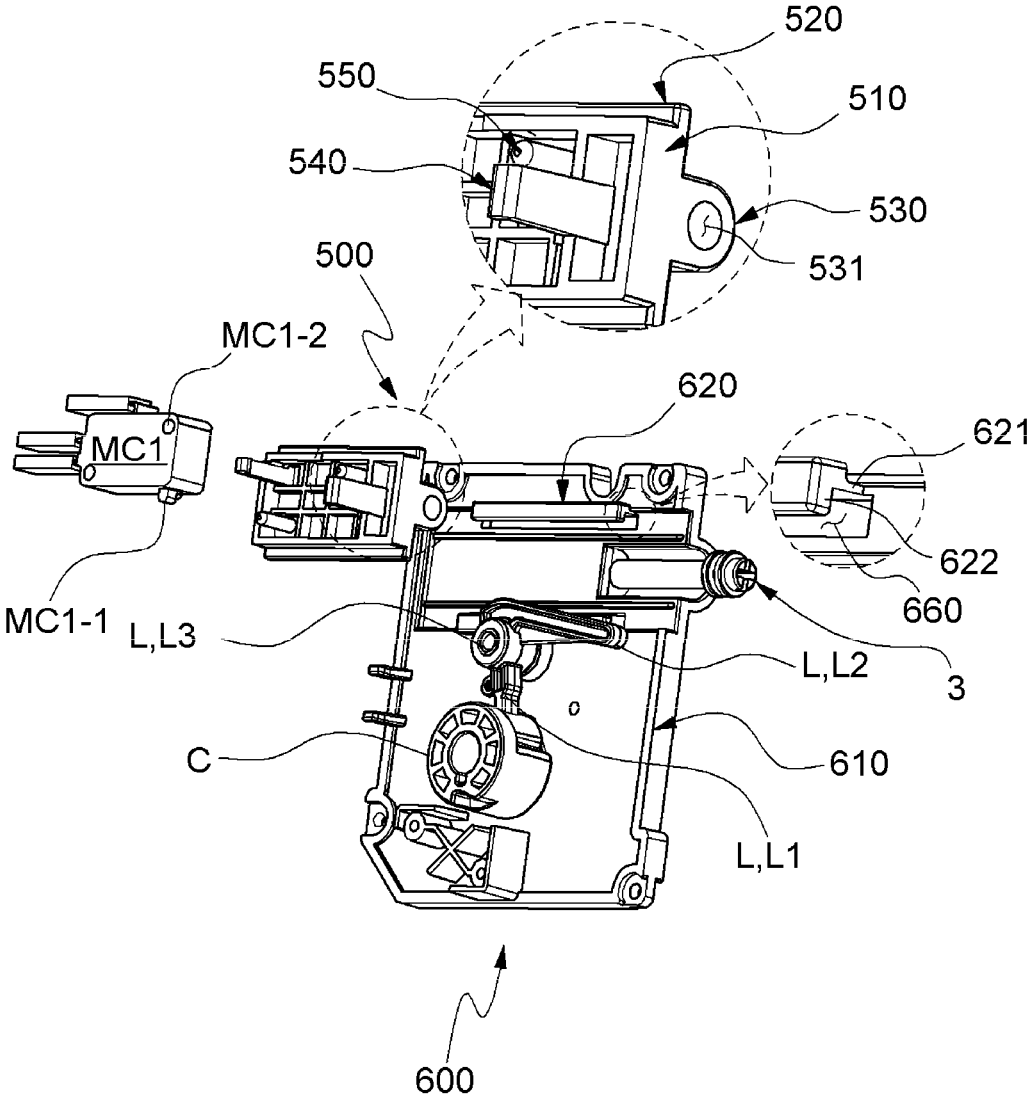
FIGS. 4 to 7 are partial perspective views illustrating the water supply adjusting apparatus of the ice maker according to an embodiment of the present invention.
Figure 5:
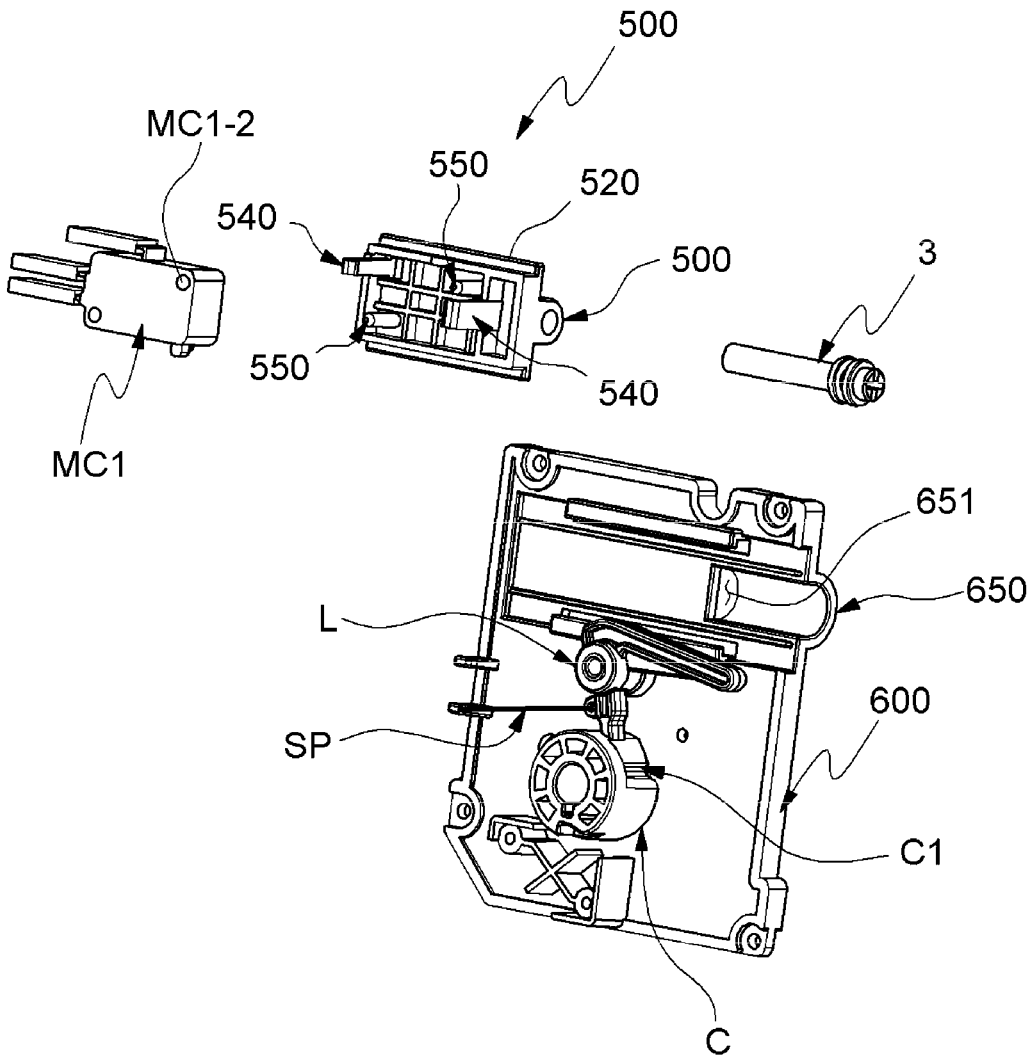
Figure 6:
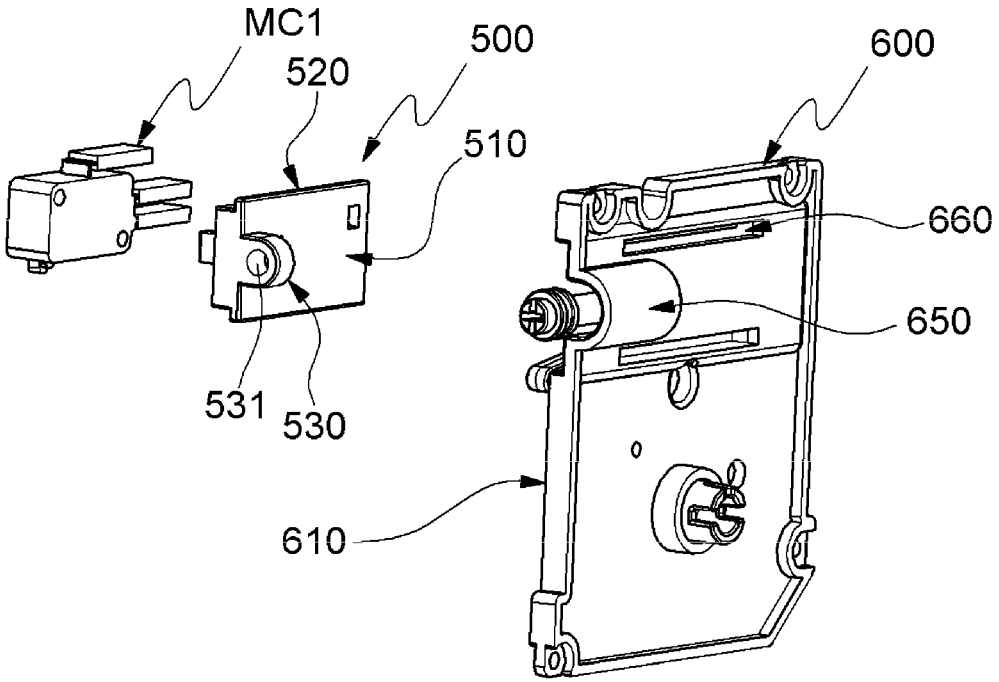

As illustrated in FIG. 3, the ice maker with a water supply adjusting apparatus according to an embodiment of the present invention includes a driver (D of FIG. 10); the same shall apply hereinafter) that drives an operation cam C, and a water supply adjusting apparatus 10 interlocked with the operation cam C and adjusting an operating time of an adjusting micro switch MC1. Here, the water supply adjusting apparatus 10 includes an operation lever L driven in contact with the operation cam C, a plate-shaped bracket 600 having the operation lever L installed therein and provided inside an inner housing H1, a holder 500 movably installed in the bracket 600 and having the adjusting micro switch MC1 fixed thereto, and a control screw 3 penetrating the inner housing H1 and threaded on the holder 500.

As illustrated in FIG. 3, the adjusting micro switch MC1 is installed in the holder 500. The holder 500 is movably installed in the bracket 600 and is threaded with the control screw 3. One side of the control screw 3 is exposed to the outside of the inner housing H1 and the other side thereof is combined with the holder 500

Therefore, when the control screw 3 is rotated, the holder 500 threaded with the control screw 3 moves in a left-right direction, when viewed from the drawing. If the holder 500 moves in the left-right direction, a distance between the operation lever L and the adjusting micro switch MC1 varies, thereby changing a time in which the operation terminal MC1-1 is pressed. If the time in which the operation terminal MC1-1 is pressed is changed, an operating time of a water supply valve (not shown) is changed, thereby changing a water supply time. According to this operation, the water supply time can be controlled, which will later be described.

As described above, according to the present invention, since the control screw 3 is exposed to the outside of the inner housing H1, it is not necessary to deconstruct a housing, unlike in the prior art, thereby easily adjusting the water supply time. In addition, as described above, if only the control screw 3 and the holder 500 are provided, the position of the adjusting micro switch MC1 can be changed, thereby providing a simplified configuration.

As illustrated in FIGS. 3 to 6, the holder 500 includes a plate-shaped holder body 510 having the adjusting micro switch MC1 installed therein and movably installed on the bracket 600, and a screw inserting portion 530 protruding on a bottom surface of the holder body 510 and threaded with the control screw 3. Here, the screw inserting portion 530 has a ring shape and is elongated in a direction in which the holder 500 is moved. That is to say, the screw inserting portion 530 is formed to extend in the left-right direction, when viewed from the drawings. If the control screw 3 is inserted into an insertion hole 531 of the screw inserting portion 530 and the control screw 3 is rotated, the screw inserting portion 530 moves in the left-right direction, when viewed from the drawings, and the adjusting micro switch MC1 moves consequently.

The bracket 600 includes a plate-shaped bracket body 610 provided in the inner housing H1 and a screw mounting groove 650 concavely formed in the bracket body 610 to allow the screw inserting portion 530 and the control screw 3 to be placed therein.

Here, the screw inserting portion 650 is concavely formed in an arc having a predetermined curvature and is elongated in a direction in which the holder 500 is moved. That is to say, since the screw mounting groove 650 is concavely formed and the screw inserting portion 530 is formed to protrude, the screw inserting portion 530 is accommodated in the screw mounting groove 650.

The control screw 3 is engaged with the screw inserting portion 530. Therefore, when the control screw 3 is rotated, the screw inserting portion 530 is moved in the screw mounting groove 650. An opening portion 651 is formed at an end part of the screw mounting groove 650, the end part disposed at a side of the center of the bracket 600. This is for the purpose of coping with a length variation of the control screw 3 by making an end of the control screw 3 penetrate the opening portion 651 even when the control screw 3 is quite long.

The holder 500 is moved by the control screw 3, as described above. For stable movement of the holder 500, as illustrated in FIGS. 3 to 6, the holder 500 further include an insertion pin 550 formed on the holder body 510 and penetrating a fixing hole MC1-2 of the adjusting micro switch MC1, a clamp 540 formed on a top surface of the holder body 510 in an inverted L shape to come into contact with side and top surfaces of the adjusting micro switch MC1, and an insertion blade 520 protruding on a side surface parallel with a direction in which the holder body 510 is moved In other words, the insertion pin 550 is inserted into the fixing hole MC1-2 of the adjusting micro switch MC1 and primarily fixes the adjusting micro switch MC1. In addition, the clamp 540 is formed on the top surface of the holder body 510 in an inverted L shape and presses the side and top surfaces of the adjusting micro switch MC1. With this configuration, the adjusting micro switch MC1 is stably fixed to the holder 500.

The bracket 600 further includes a guide 620 formed in the bracket body 610 formed in the bracket body 610 to be combined with the insertion blade 520. The guide 620 has a vertical portion 621 upwardly protruding on the bracket body 610 and a horizontal portion 622 horizontally bent at an end of the vertical portion 621. Here, the vertical portion 621 and the horizontal portion 622 extend in the direction in which the holder body 510 is moved, and the insertion blade 520 is in contact with a bottom surface of the horizontal portion 622 and a side surface of the vertical portion 621. That is to say, the insertion blade 520 is moved in contact with the bottom surface of the horizontal portion 622 and the side surface of the vertical portion 621, thereby achieving stable movement of the adjusting micro switch MC1.

An opening portion 660 is formed in the bracket body 610 corresponding to the bottom surface of the horizontal portion 622. The opening portion 660 may reduce a weight of the bracket 600

The control screw 3 includes a screw portion 3-2 threaded with the screw inserting portion 530, a head portion 3-1 provided at one-side end of the screw portion 3-2 to be combined with an operation tool, and a pair of lock valves 3-3 formed at exterior sides of the screw portion 3-2 and shaped of a plate. The screw portion 3-2 is threaded with the insertion hole 531 of the screw inserting portion 530.

Figure 8:
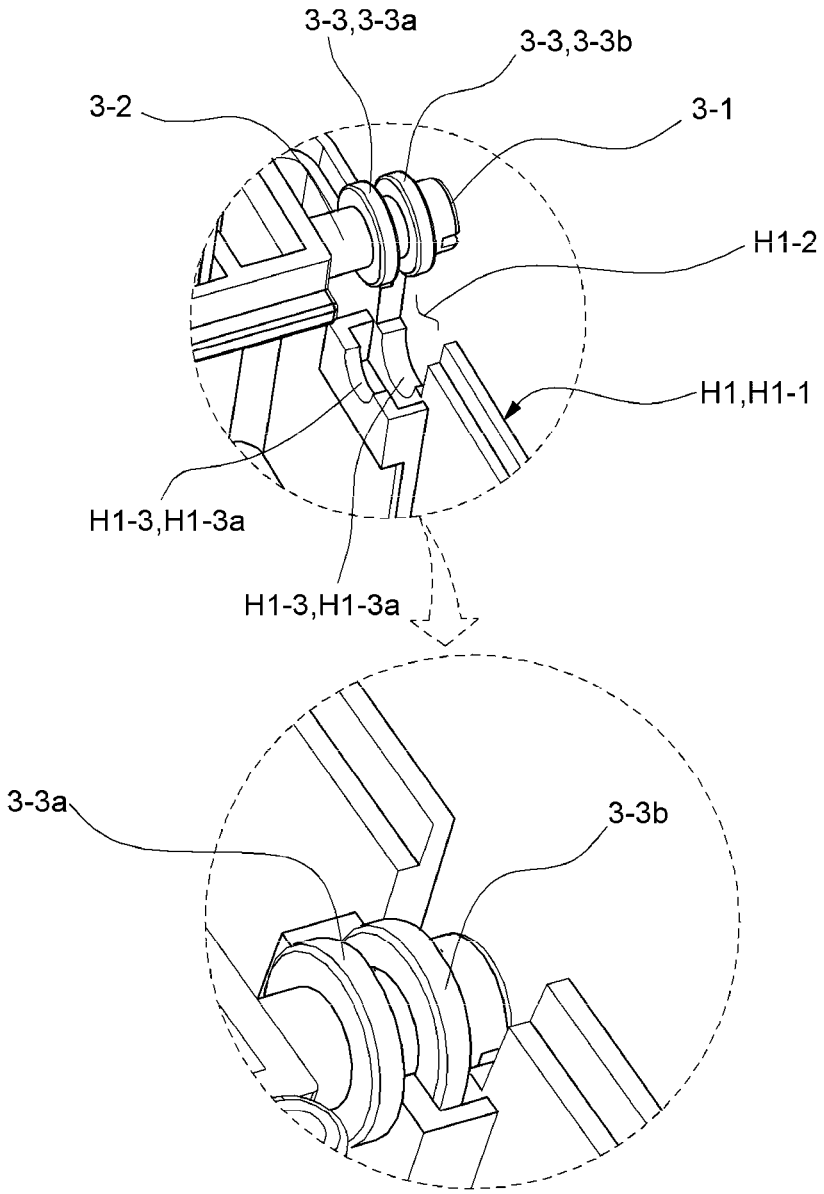
FIG. 8 is a partly cut-away perspective view illustrating that a screw portion and an inner housing of the water supply adjusting apparatus of the ice maker according to an embodiment of the present invention are assembled with each other.
Figure 10:
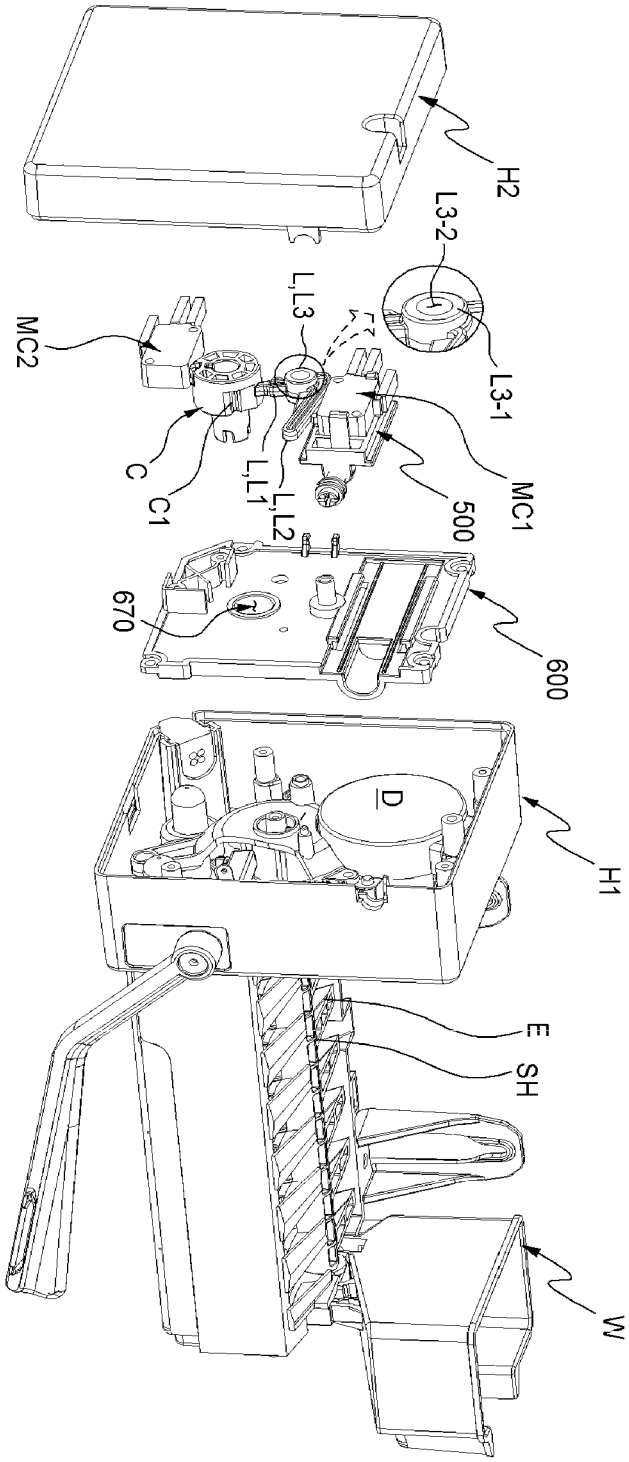
FIGS. 10 and 11 are exploded perspective views illustrating a connection mechanism of the water supply adjusting apparatus of the ice maker according to an embodiment of the present invention.

The inner housing H1 includes an inner housing body H1-1 being hollow and having an opened side surface disposed at a side of the outer housing (H2 of FIG. 10). In addition, a penetration hole H1-2 is formed in one side of the inner housing body H1-1 for insertion of the control screw 3 (FIG. 8). A pocket H1-3 is also formed on an internal surface of the inner housing body H1-1 having the penetration hole H1-2.

The pocket H1-3 is shaped of a hollow box having an open top surface. One of the pair of lock valves 3-3, that is, an outer lock valve 3-3*b* positioned outside the inner housing H1, is mounted in an inner space of the pocket H1-3, and housing mounting grooves H1-3*a* are formed on top surfaces of inner and outer partitions of the pocket H1-3, respectively, to allow the outer surface of the screw portion 3-2 disposed between the pair of lock valves 3-3 and the head portion 3-1 to be mounted therein. With this configuration, the control screw 3 can be stably rotated.

As illustrated in FIGS. 3 to 5 and FIG. 9, an operation lever L includes an central part L3 movably installed on the bracket 600, a first lever L1 provided at one side of the central part L3 and ascending and descending in contact with an operation groove C1 of the operation cam C, and a second lever L2 provided at the other side of the central part L3, interlocked with the first lever L1 to then ascend and descend, and pressing an operation terminal MC1-1 of the adjusting micro switch MC1.

The central part L3 is provided between the holder 500 and the operation cam C, The first lever L1 is formed to extend from the central part L3 to the operation cam C to come into contact with the operation cam C, and the second lever L2 is formed to extend from the central part L3 in a direction in which the adjusting micro switch MC1 is moved.

The second lever L2 includes an extending part L2-1 formed to extend from the central part L3 in a direction in which the second lever L2 approaches the adjusting micro switch MC1, and a pressing part L2-2 extending from an end of the extending part L2-1 to the operation terminal MC1-1, formed to be tilted in a direction in which it gets far away from the adjusting micro switch MC1, and pressing the operation terminal MC1-1. Like in the illustrated embodiment, when the adjusting micro switch MC1 is moved in a horizontal direction when viewed from the drawing, the second lever L2 is formed in the horizontal direction, accordingly. Here, the extending part L2-1 is formed to extend from the central part L3 in a vertical direction when viewed from the drawing and approaches the adjusting micro switch MC1. The pressing part L2-2 is formed to extend from an end of the extending part L2-1 in a direction in which the adjusting micro switch MC1 is moved, that is, in the horizontal direction when viewed from the drawing, and extends in a direction in which the pressing part L2-2 faces the operation terminal MC1-1, that is, in the right direction when viewed from the drawing. However, the pressing part L2-2 is not formed to be parallel with the moving direction but is formed to get far away from the adjusting micro switch MC1. Therefore, in the illustrated embodiment, the pressing part L2-2 is disposed to be downwardly tilted toward the right side when viewed from the drawing. Here, the second lever L2 is formed to be longer than the first lever L1.

Figure 9:
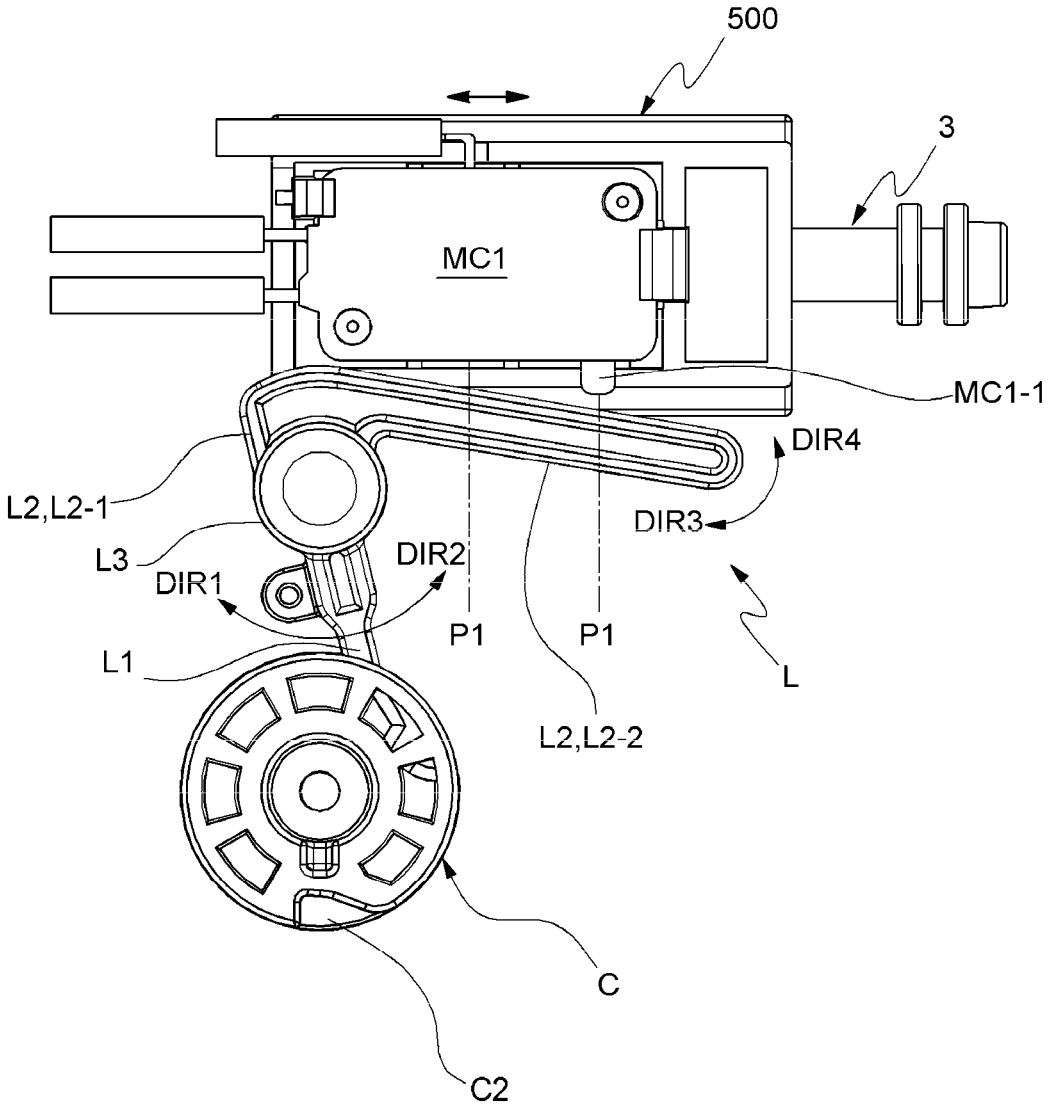
FIG. 9 is a schematic view illustrating an operating mechanism of the water supply adjusting apparatus of the ice maker according to an embodiment of the present invention.

The water supply time can be adjusted by the water supply adjusting apparatus 10 according to the present invention, which will now be described with reference to FIG. 9.

First, if the first lever L1 is inserted into the operation groove (C1 of FIG. 3) of the operation cam C and descends while the operation cam C is rotated by the driver D, the second lever L2 rotates around the central part L3 in a third direction DIR3 to then descend. If the second lever L2 descends, a pressed state of the operation terminal MC1-1 of the adjusting micro switch MC1 is cancelled. Accordingly, the operation of the water supply valve, which is controlled by the adjusting micro switch MC1, is interrupted to stop supplying water.

Figure 1:
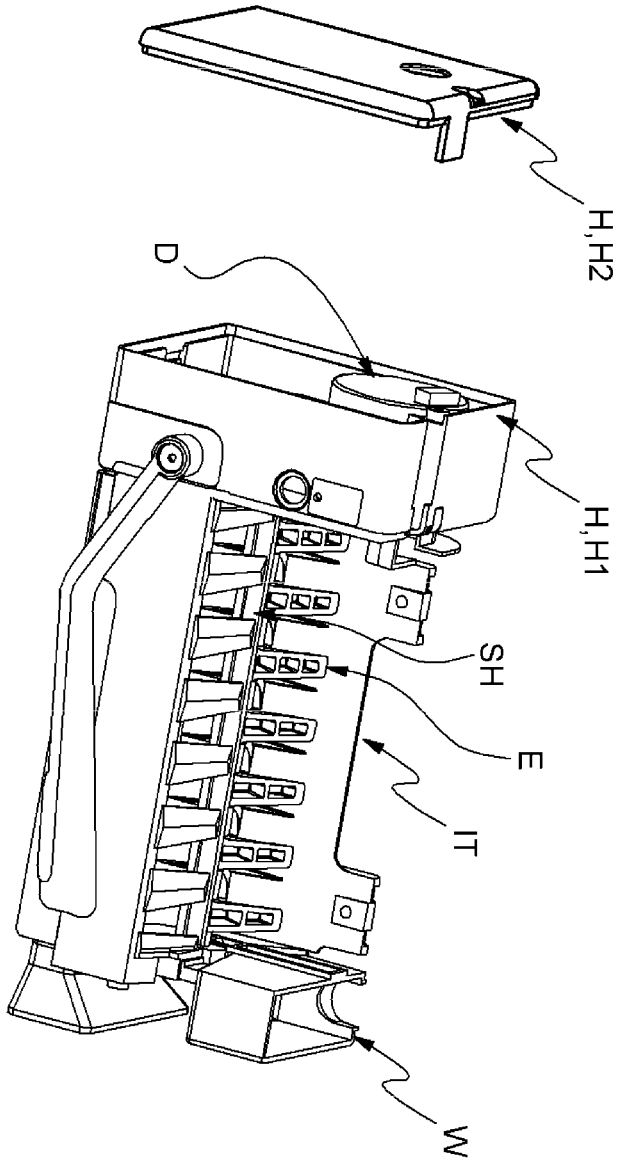
FIGS. 1 and 2 are perspective views illustrating a general ice maker.

If the operation cam C is additionally rotated, the first lever L1 deviates from the operation groove C1 to ascend in a second direction DIR2. Accordingly, the second lever L2 ascends in a fourth direction DIR4. The ascending second lever L2 presses the operation terminal MC1-1 of the adjusting micro switch MC1 to actuate the water supply valve, thereby supplying water to the ice tray (IT of FIG. 1).

In other words, water may be supplied to the ice tray IT for a period of time in which the operation terminal MC1-1 is pressed. In order to adjust the water supply time, a position of the adjusting micro switch MC-1 may be changed.

In a state in which the adjusting micro switch MC-1 is positioned at a position 1 P1, for example, the adjusting micro switch MC-1 may be moved to the right, when viewed from the drawing, to be positioned at a position 2 P2. Then, a time in which the operation terminal MC1-1 is pressed by the pressing part L2-2 of the second lever L2 is reduced. This is attributed to the pressing part L2-2 formed such that it approaches the adjusting micro switch MC1-1 toward the left side when viewed from the drawing.

That is to say, when the adjusting micro switch MC1 is positioned at the second position P2, the time in which the operation terminal MC1-1 is pressed by the pressing part L2-2 is shorter than when the adjusting micro switch MC1 positioned at the first position P1, thereby reducing the water supply time. Conversely, if the adjusting micro switch MC1 is moved from the second position P2 to the first position P1, the water supply time can be reduced.

Alternatively, the second lever L2 may also be formed to be longer than the first lever L1. That is to say, if a length of the pressing part L2-2 is increased by increasing a length of the second lever L2, the adjusting micro switch MC1 may be variably disposed at many positions, thereby accurately adjusting the time in which the operation terminal MC1-1 is pressed by the pressing part L2-2.

The central part L3 includes a central part body L3-1, and an insertion hole L3-2 formed in the central part body L3-1. An insertion bar 630 protruding from the bracket 600 is inserted into the insertion hole L3-2, so that the central part L3 is rotatably installed in the bracket 600.

Figure 11:
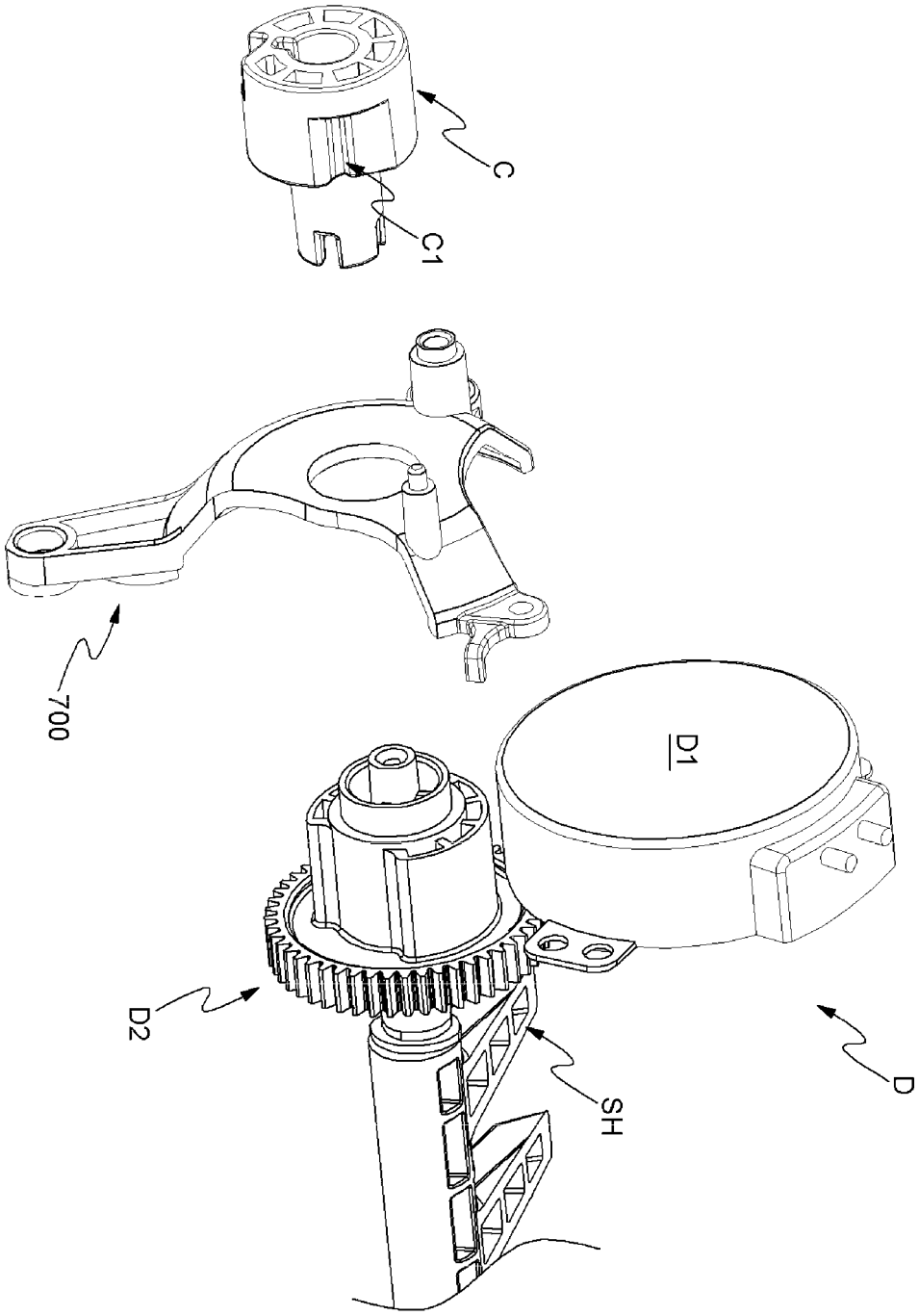
Figure 12:
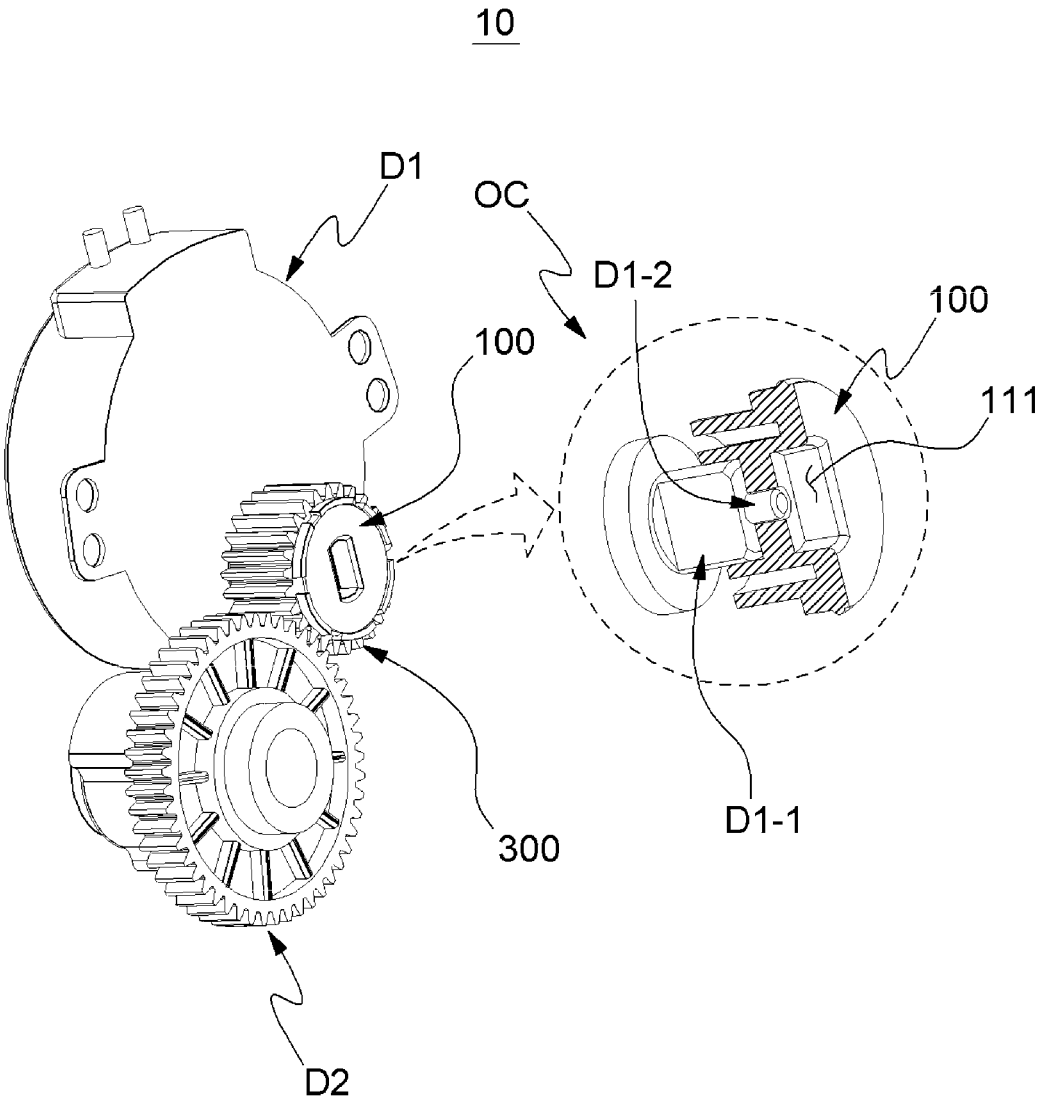
FIG. 12 is a partial perspective view illustrating a connection mechanism of the driver in the ice maker according to an embodiment of the present invention.
Figure 13:
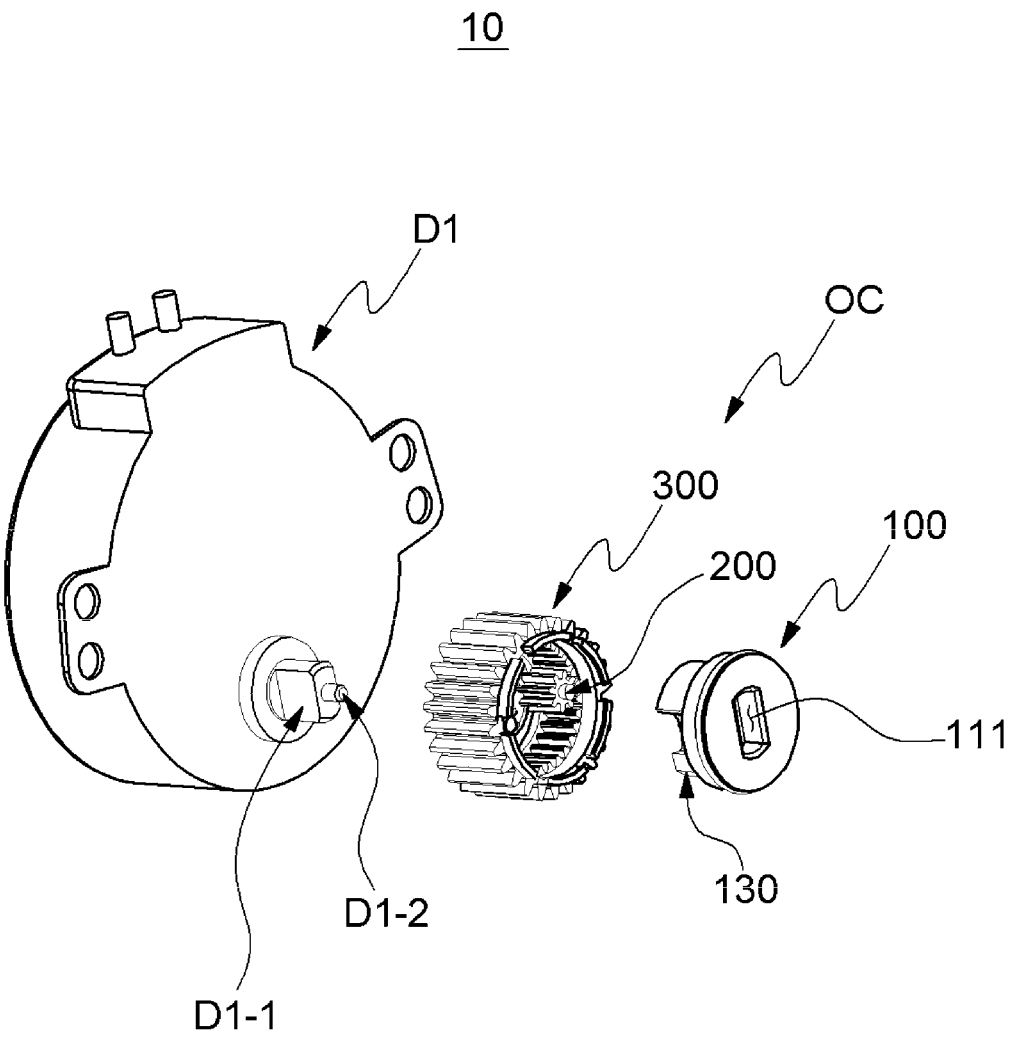
FIG. 13 is an exploded perspective view illustrating the connection mechanism of the driver in the ice maker according to an embodiment of the present invention.
Figure 14:
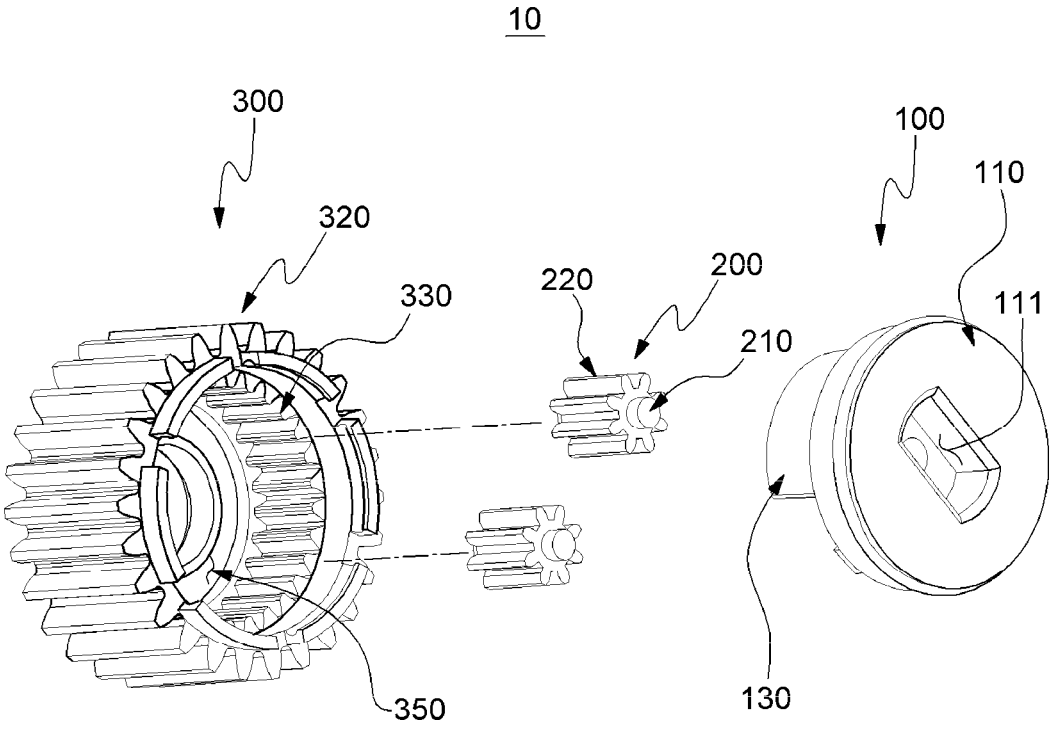
FIGS. 14 and 15 are exploded perspective views illustrating a drive cam and a driving gear of the driver in the ice maker according to an embodiment of the present invention.

The operation cam C is driven by the driver D. As illustrated in FIGS. 10 to 12, the driver D includes a drive cam D2 driving an ice-separating shaft SH and interlocked with the operation cam C, a drive actuator D1 that actuates the drive cam D2 by providing a one-directional rotating power, and a one-way clutch OC provided between the drive cam D2 and the drive actuator D1. That is to say, if a rotating power is generated by the drive actuator D1 using an electronically driven motor, etc., the rotating power is transmitted to the operation cam C through the drive cam D2, so that the operation cam C is rotated. As illustrated in FIG. 10, the driver D is provided between the bracket 600 and a bottom surface of the inner housing H1. In order to make the drive cam D2 and the operation cam C interlock with each other, an opening hole 670 is formed in the bracket 600.

Figure 2:
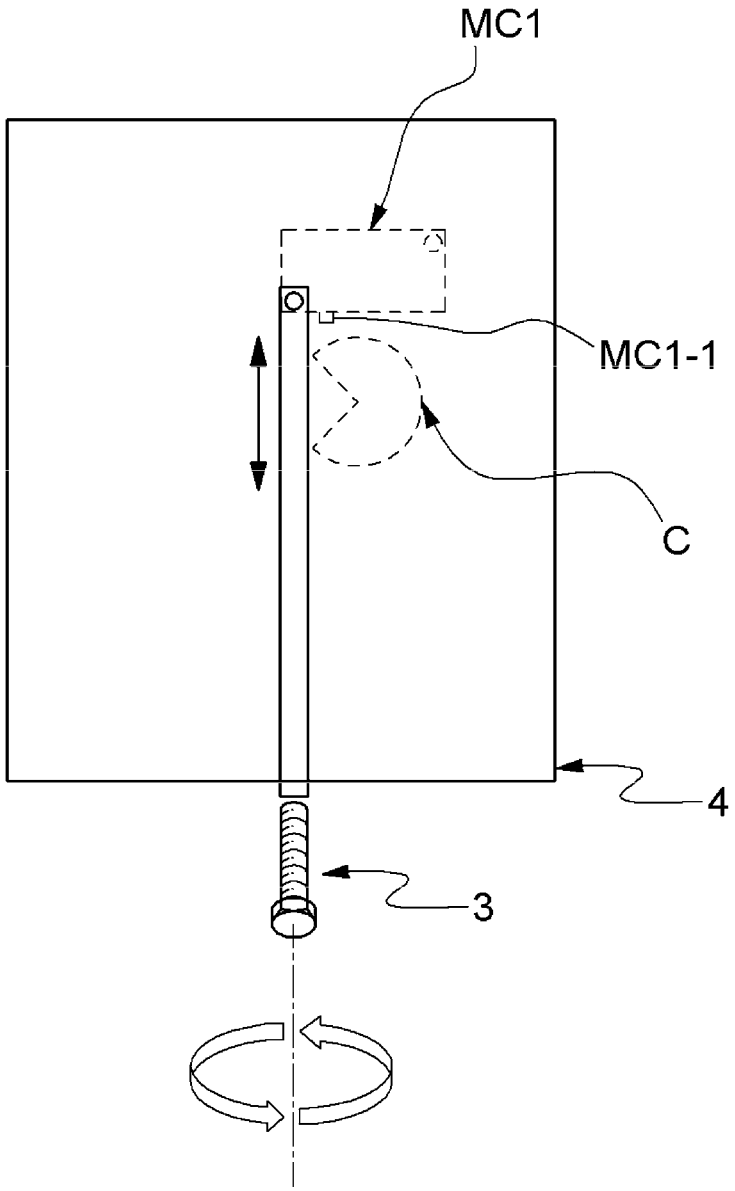
Figure 7:
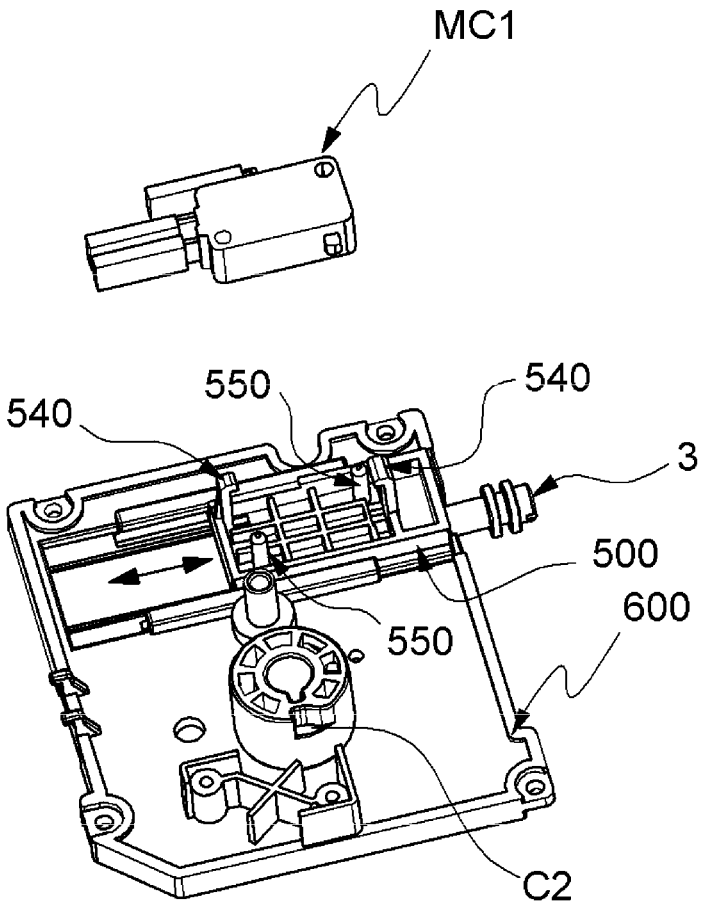

Reference mark MC2 that is not defined in FIG. 2 denotes a micro switch for checking out the origin and is driven by a separate operation groove (C2 of FIG. 7,9) of the operation cam C to check out the origin of the ice-separating shaft SH.

The one-way clutch OC allows power transmission from the drive actuator D1 to the drive cam D2 but blocks power transmission in the opposite direction, that is, from the drive cam D2 to the drive actuator D1. Therefore, when a general ice maker is normally driven, a rotating power is transmitted from the drive actuator D1 to the drive cam D2 to perform an ice-separating operation. When a user directly drives the drive cam D2 for testing the ice maker, the rotational force is not transmitted to the drive actuator D1, thereby preventing the drive actuator D1 from being damaged.

As illustrated in FIGS. 12 to 19, the one-way clutch OC includes a driving gear 300 interlocked with the drive cam D2, one or more idling gears 200 engaged with an internally toothed portion 330 of the driving gear 300, and a cap 100 inserted into the interior of the internally toothed portion 330 and interlocked with the drive actuator D1 to intermittently effectuate rotation of the one or more idling gears 200.

Here, when the cap 100 is rotated by the drive actuator D1 in one direction, a portion of the cap 100 comes into contact with each of the one or more idling gears 200 to interrupt the rotation of the idling gear 200 and to allow power to be transmitted from the drive actuator D to the drive cam D2.

In addition, when the drive cam D2 is rotated by an external force in the opposite direction, the idling gear 200 is engaged with the internally toothed portion 330 and then rotated to block power transmission between the drive actuator D1 and the drive cam D2, which will later be described.

The cap 100 includes a cap body 110 shaped of a plate and interlocked with the drive actuator D1 and a intermittently power-transmitting portion) 130 protruding from the cap body 110 and inserted into the interior of the internally toothed portion 130 of the driving gear 300.

Here, the intermittently power-transmitting portion 130 includes a cylindrical main body 131, a cutout portion 134 formed by partially cutting out one side of the main body 131 of the intermittently power-transmitting portion 130 in a radial direction to allow the idling gear 200 to be placed therein, and a wedge portion 132 and an arc portion 133 formed at places where opposite ends of the cutout portion 134 and the main body 131 meet, respectively.

Figure 15:
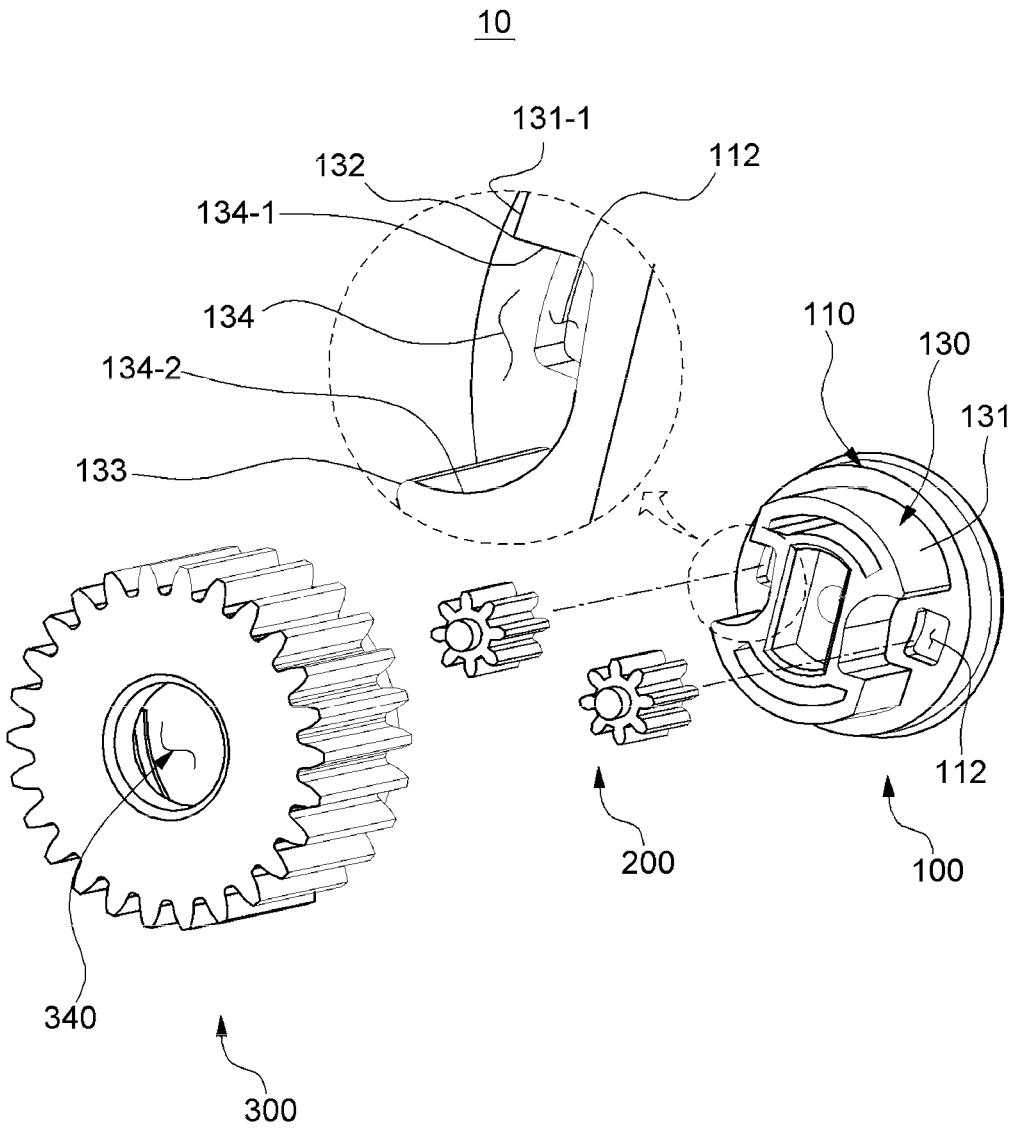
Figure 16:
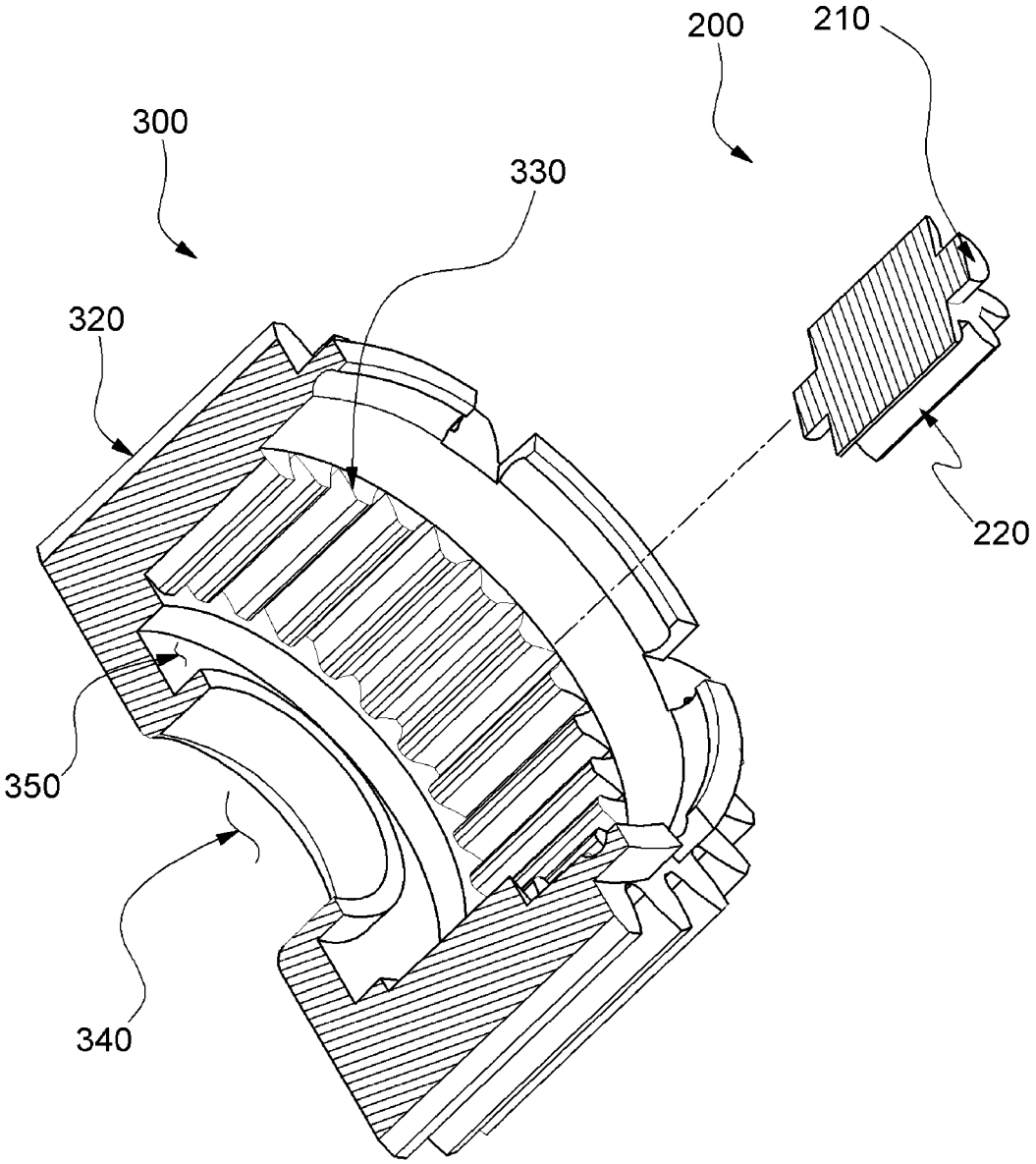
FIGS. 16 and 17 are cross sectional views illustrating states in which a drive gear and a cap of the driver in the ice maker according to an embodiment of the present invention are assembled with and disassembled from each other.
Figure 17:
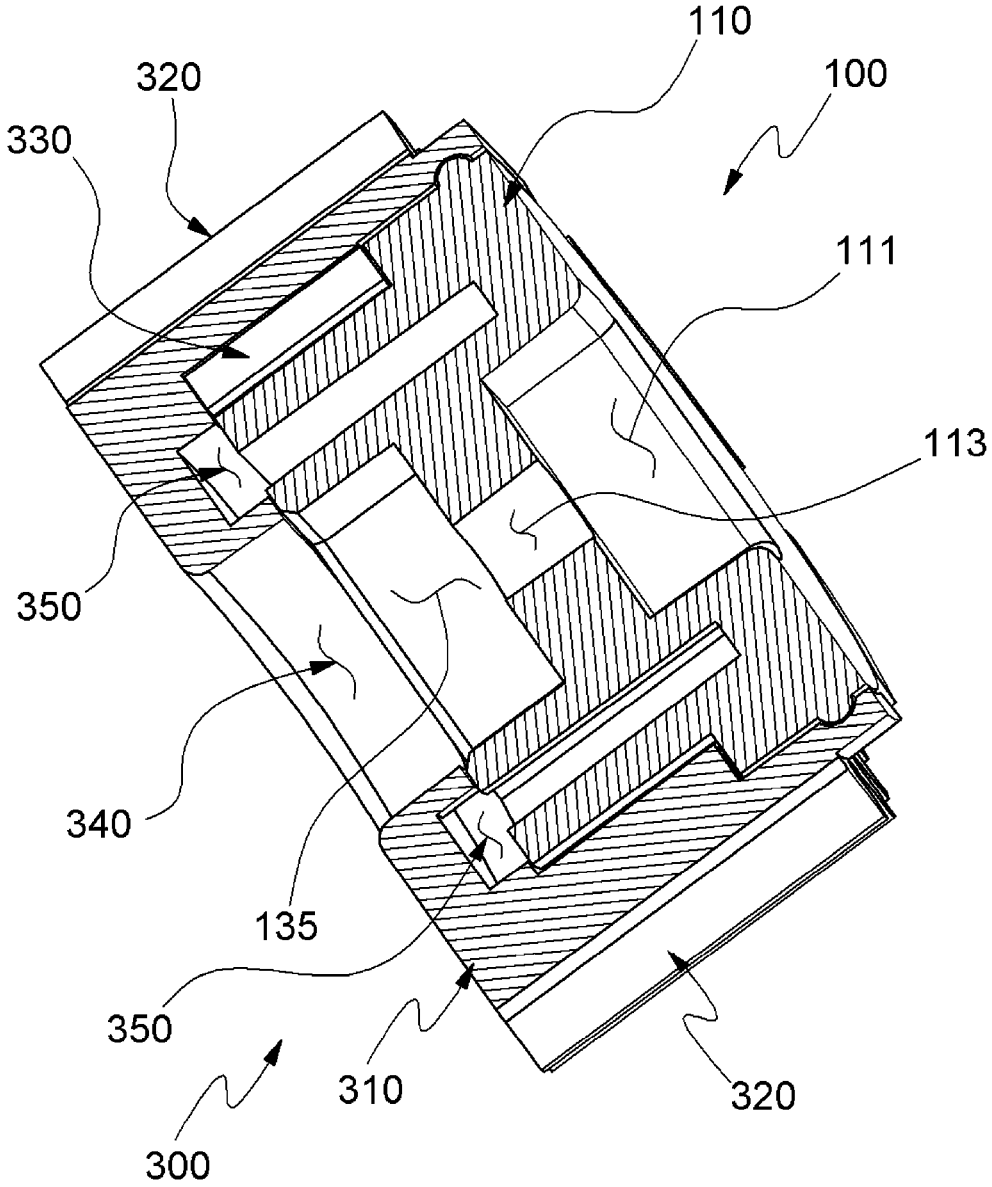
Figure 18:
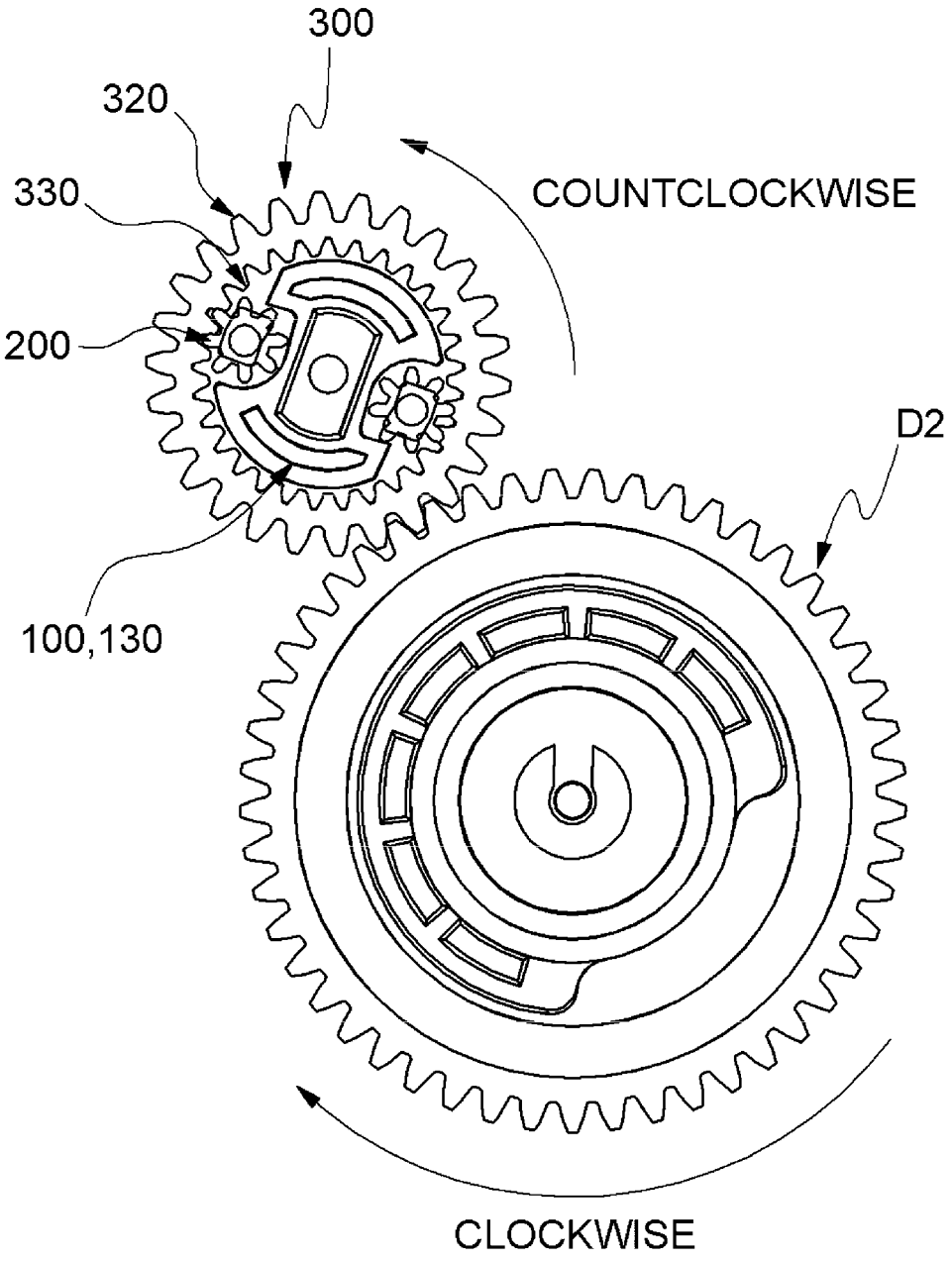
FIGS. 18 and 19 are conceptual views for explaining power transmission or interruption performed by the driver of the ice maker according to an embodiment of the present invention.
Figure 19:
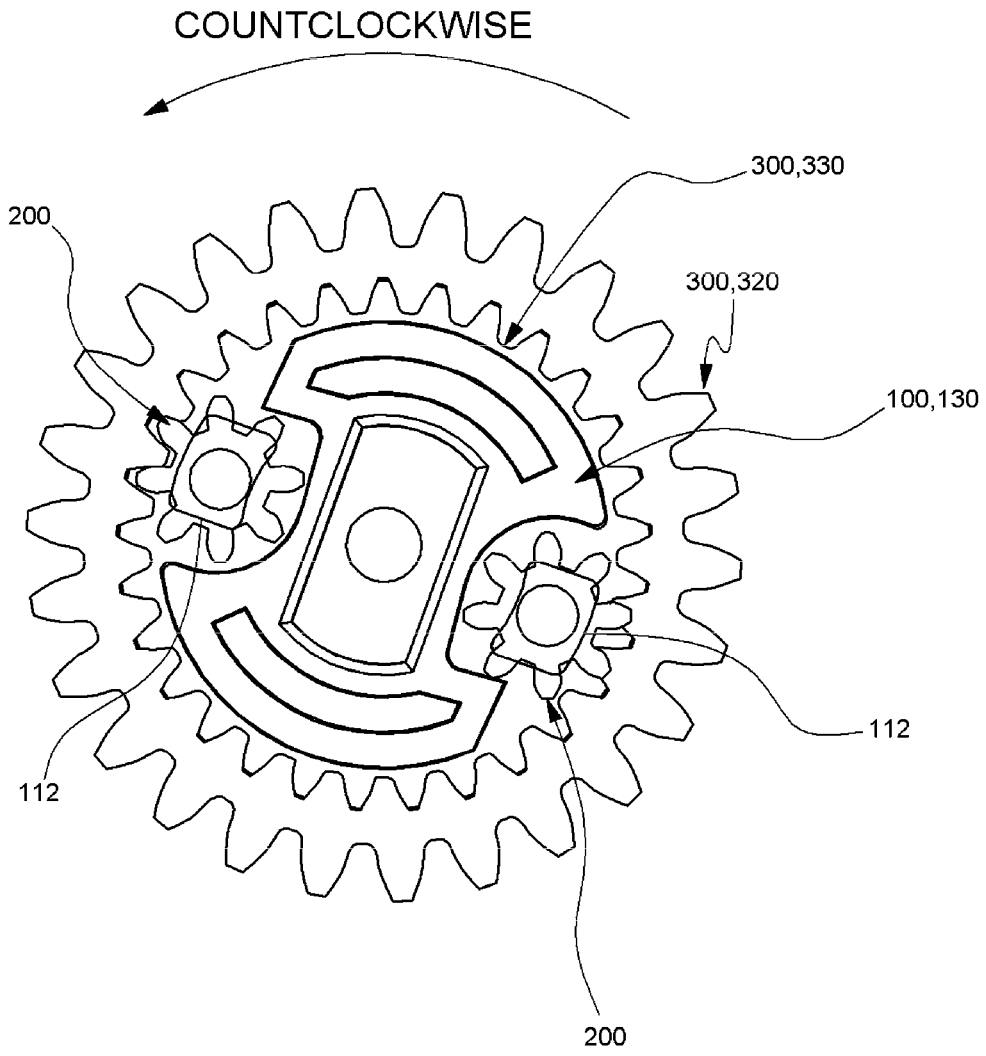

That is to say, as shown, the main body 131 is shaped of a cylinder and is disposed at the interior of the internally toothed portion 130 of the driving gear 300. One side of the main body 131 of the intermittently power-transmitting portion 130, that is, a portion of either side of the main body 131 in the embodiment illustrated in FIG. 15, is cut out in a radial direction, so that the main body 131 has a roly-poly construction as a whole. The idling gear 200 is mounted in the cap body 110 through a space created by the cutout portion 134.

The wedge portion 132 is bent at a predetermined angle to be inserted into teeth of the idling gear 200 according to the rotation of the cap body 110, and the arc portion 133 has a side surface disposed at a side of the idling gear 200, the side surface being formed to be curved with a predetermined curvature, so as not to come into contact with the idling gear 200 even when the cap body 110 is rotated.

As described above, the wedge portion 132 is formed at a place where one end of the cutout portion 134 and the main body 131 meet and is cut out by a predetermined angle. To this end, the main body 131 in contact with the wedge portion 132 may be formed as a planar surface 131-1, and the cutout portion 134 in contact with the wedge portion 132 may also be formed as a planar surface 134-1. The wedge portion 132 may come into contact with both of the planar surfaces 131-1 and 134-1 to then be sharply formed with a predetermined angle (e.g., 90 degrees).

In addition, as illustrated, a side surface of the arc portion 133, which is disposed at a side of the idling gear 200, the side surface being formed as a curved surface 134-2 having a predetermined curvature. The curved surface 134-2 is spaced a predetermined distance apart from the idling gear 200 (?) so as not to come into contact with the idling gear 200 even when the cap body 110 is rotated, which will later be described.

When the intermittently power-transmitting portion 130 is rotated by the drive actuator D2 in one direction, the wedge portion 132 is formed at one side surface of the intermittently power-transmitting portion 130, the one side surface approaching the idling gear 200. For example, when the intermittently power-transmitting portion 130 is rotated in a counterclockwise direction, the wedge portion 132 is formed at one side surface of the intermittently power-transmitting portion 130, that is, in the right side of the idling gear 200, when viewed from in the drawing (see FIG. 8), so as to approach the idling gear 200. When the intermittently power-transmitting portion 130 is rotated by the drive actuator D2 in the opposite direction, the wedge portion 132 is formed at the other side surface of the intermittently power-transmitting portion 130, that is, in the left side of the idling gear 200, when viewed from in the drawing, the other side surface getting far away from the idling gear 200.

Meanwhile, a mounting groove 112 is formed in a portion of the cap body 110 corresponding to a bottom of the cutout portion 134 so that a portion of the idling gear 200 is inserted into the mounting groove 112. The mounting groove 112 is formed in a circumferential direction of the cap body 110, as illustrated in FIG. 15. The mounting groove 112 allows the idling gear 200 to revolve.

A rotating power generated from the drive actuator D1 is transmitted to the cap 100. To this end, a plate-shaped insertion groove 133 is concavely formed in the main body 131. A locking groove 111 is concavely formed at a side surface of the cap body 110, the side surface opposite to the main body 131. A penetration hole 113 is formed in a bottom of the locking groove 111, so that the insertion groove 133 and the locking groove 111 are communicated with each other.

The drive actuator D1 includes a driving plate D1-1 having a plate shape and rotating and a protrusion bar D1-2 formed at an ending part of the driving plate D1-1. Here, the driving plate D1-1 is inserted into the insertion groove 133 to be locked, and the protrusion bar D1-2 is inserted into the penetration hole 113. That is to say, when the driving plate D1-1 is rotated by the drive actuator D1, the intermittently power-transmitting portion 130 is locked on the driving plate D1-1 to then be rotated, thereby rotating the entire cap 100. Since the protrusion bar D1-2 is inserted into the penetration hole 113, the driving plate D1-1 can be stably rotated. A widely known electronically driven motor may be used as the drive actuator D1 and detailed descriptions and illustration thereof will not be given.

The driving gear 300 is interlocked with the drive cam D2. The rotating power may be transmitted to the driving gear 300 or may be blocked by the intermittently power-transmitting portion 130 of the cap 100. The driving gear 300 includes a gear body 310, an internally toothed portion 330 and an externally toothed portion 320.

The driving gear 300 is interlocked with the drive cam D2. The rotating power may be transmitted to the driving gear 300 or may be blocked by the intermittently power-transmitting portion 130 of the cap 100. The driving gear 300 includes a gear body 310, an internally toothed portion 330 and an externally toothed portion 320.

The gear body 310 is shaped of a hollow cylinder having an opened side surface disposed at a side of the cap 100 and a closed side surface disposed opposite to the opened side surface, and a portion of the gear body 310 is opened by forming a penetrating portion 340. The internally toothed portion 330 having a tooth shape is formed on an inner surface of the gear body 310. The externally toothed portion 320 having a tooth shape is formed on an outer surface of the gear body 310.

A side of the gear body 310, which is disposed at a side of the cap 100, that is, the right side when viewed from the drawing, is opened, and the opposite side, that is, the left side when viewed from the drawing, is closed. The penetrating portion 340 is formed on the closed side of the gear body 310. The driving plate D1-1 of the drive actuator D1 penetrates the penetrating portion 340 and is then inserted into the insertion groove 133.

The internally toothed portion 330 is formed on the inner surface of the gear body 310, and the externally toothed portion 320 is formed on the outer surface of the gear body 310. The idling gear 200 is engaged with the internally toothed portion 330, and the cap body 110 of the cap 100 and the intermittently power-transmitting portion 130 are inserted into the internally toothed portion 330.

A groove portion 350 is formed around the penetrating portion 340 on the inner surface of the gear body 310 in a circumferential direction. The idling gear 200 is to be mounted on the groove portion 350.

The idling gear 200 includes a bar-shaped shaft 210 and a toothed portion 220 formed around the shaft 210 to be engaged with the internally toothed portion 330 of the driving gear 300. Here, one end of the shaft 210 is inserted into the groove portion 350 of the driving gear 300, and the other end of the shaft 210 is inserted into the mounting groove 112 of the cap 100.

Hereinafter, an ice maker driving method using the ice maker according to the present invention will be described.

As described above, the ice maker according to the present invention includes a drive cam D2 that drives an ice-separating shaft SH of the inventive ice maker, a drive actuator D1 that actuates the drive cam D2 by providing a one-directional rotating power, and a one-way clutch OC provided between the drive cam D2 and the drive actuator D1. The one-way clutch OC includes a driving gear 300 interlocked with the drive cam D2, one or more idling gears 200 engaged with an internally toothed portion 330 of the driving gear 300, and a cap 100 inserted into the interior of the internally toothed portion 330 and interlocked with the drive actuator D1 to intermittently effectuate rotation of the one or more idling gears 200. When the cap 100 is rotated by the drive actuator D1 in one direction, the cap 100 comes into contact with each of the one or more idling gears 200 at its one portion to allow power to be transmitted between the drive actuator D1 and the drive cam D2 while interrupting the rotation of the idling gear 200. When the drive cam D2 is rotated by an external force in the opposite direction, the idling gear 200 is engaged with the internally toothed portion 330 and then rotated to block the power transmission between the drive actuator D1 and the drive cam D2.

The drive actuator D1 generates a one-directional rotating power, which will now be described with a counterclockwise rotating power by way of example.

When an ice maker is normally operated, the drive actuator D1 rotates the cap 100 in one direction, that is, in a counterclockwise direction, which is because the drive actuator D1 and the cap 100 are interlocked with each other, as described above.

The wedge portion 132 of the cap 100 is inserted into teeth of the idling gear 200 according to counterclockwise rotation of the cap 100 to make the idling gear 200 stop rotating.

That is to say, the idling gear 200 is engaged with the internally toothed portion 330 of the driving gear 300. In such a state, if the cap 100 rotates in the counterclockwise direction, the wedge portion 132 is inserted into the idling gear 200. As the wedge portion 132 is inserted into the idling gear 200, the idling gear 200 is prohibited from rotating. Here, since the wedge portion 132 continuously presses the idling gear 200 in the counterclockwise direction, the idling gear 200 revolves in the counterclockwise direction. Since the driving gear 300 is engaged with the idling gear 200, the driving gear 300 rotates in the counterclockwise direction according to counterclockwise revolution of the idling gear 200. According to the counterclockwise rotation of the driving gear 300, the drive cam D2 rotates in a clockwise direction to then rotate the ice-separating shaft SH, thereby performing an ice-separating operation.

When the ice maker is tested, the drive cam D2 is forcibly rotated by an external force, that is, by a user, in the opposite direction, that is, in a clockwise direction. Accordingly, the driving gear 300 rotates in one direction, that is, in a counterclockwise direction. If the driving gear 300 rotates in the counterclockwise direction, the idling gear 200 engaged with the internally toothed portion 320 of the driving gear 300 revolves in the counterclockwise direction and gets far away from the wedge portion 132, thereby allowing the idling gear 200 to rotate. Here, since the idling gear 200 is inserted into the mounting groove 112, it can revolve in the counterclockwise direction with respect to the mounting groove 112 by a predetermined distance. In the middle of revolving in the mounting groove 112 in the counterclockwise direction, if the idling gear 200 comes into contact with an end of the mounting groove 112 to then stop revolving, the idling gear 200 rotates at the end of the mounting groove 112.

That is to say, the idling gear 200 rotates according to the rotation of the driving gear 300 and is disengaged from the intermittently power-transmitting portion 130. Therefore, the rotating power transmitted from the driving gear 300 is transmitted to only the idling gear 200 and is not transmitted to the intermittently power-transmitting portion 130. Eventually, since the rotating power is not transmitted to the intermittently power-transmitting portion 130, it is not even transmitted to the drive actuator D1, thereby preventing the drive actuator D1 from being damaged.

As described above, when the ice maker is normally operated, the rotating power generated from the drive actuator D1 is transmitted to the drive cam D2 through the cap 100, the idling gear 200 and the driving gear 300.

If the user forcibly drives the drive cam D2 for testing the ice maker, the rotating power is transmitted to only the driving gear 300 and the idling gear 200 and is not transmitted to the cap 100. Therefore, the rotating power is not transmitted to the drive actuator D1, thereby preventing the drive actuator D1 from being damaged.

Although an exemplary embodiment of the present disclosure has been shown and described with reference to accompanying drawings, it would be appreciated by those skilled in the art that the invention can be embodied in other specific forms without changing technical principles and spirit or essential features of the present disclosure. Therefore, it should be understood that the stated embodiment is considered in all respects as illustrative, not restrictive. The scope of the present invention disclosed in the detailed description is defined by claims that follow and it should be interpreted that meaning and scope of the claims and all changes or modifications derived from equivalent concepts of the present invention are considered within the scope of the disclosure.

The invention claimed is:

1. An ice maker with a water supply adjusting apparatus, the ice maker comprising:

a drive cam that drives an operation cam; and a water supply adjusting apparatus interlocked with the operation cam and adjusting an operating time of a micro switch, wherein the water supply adjusting apparatus comprises:

an operation lever driven in contact with the operation cam;

a plate-shaped bracket having the operation lever installed therein and provided inside an inner housing;

a holder movably installed in the plate-shaped bracket and having the micro switch fixed thereto; and a control screw penetrating the inner housing and having one side exposed to the outside of the inner housing and the other side threaded on the holder, wherein the holder includes a plate-shaped holder body having the micro switch installed therein and movably installed on the plate-shaped bracket, and a screw inserting portion protruding on a bottom surface of the holder body and threaded with the control screw; and the plate-shaped bracket includes a plate-shaped bracket body provided in the inner housing and a screw mounting groove concavely formed in the plate-shaped bracket body to allow the screw inserting portion and the control screw to be placed in the screw mounting groove, the screw inserting portion having a ring shape and elongated in a direction in which the holder is moved, and the screw mounting groove being formed in an arc having a predetermined curvature and elongated in a direction in which the holder is moved, so that the screw inserting portion moves in a state in which the screw inserting portion is accommodated in the screw mounting groove.

2. The ice maker of claim 1, wherein the holder further includes an insertion pin formed on the plate-shaped holder body and penetrating a fixing hole of the micro switch, a clamp formed on a top surface of the plate-shaped holder body in an inverted L shape to come into contact with side and top surfaces of the micro switch, and an insertion blade protruding on a side surface parallel with a direction in which the plate-shaped holder body is moved; and the plate-shaped bracket further includes a guide formed in the plate-shaped bracket body to be combined with the insertion blade, the guide having a vertical portion upwardly protruding on the plate-shaped bracket body and a horizontal portion horizontally bent at an end of the vertical portion, the vertical portion and the horizontal portion extending in the direction in which the plate-shaped holder body is moved, and the insertion blade being in contact with a bottom surface of the horizontal portion and a side surface of the vertical portion.

3. The ice maker of claim 2, wherein an opening portion is formed in the plate-shaped bracket body corresponding to the bottom surface of the horizontal portion.

4. The ice maker of claim 1, wherein the control screw includes a screw portion threaded with the screw inserting portion, a head portion provided at one-side end of the screw portion to be combined with an operation tool, and a pair of lock valves formed at an exterior side of the screw portion in a plate shape; and the inner housing further includes an inner housing body being hollow and having an opened side surface disposed at a side of the outer housing, a penetration hole formed in one side of the inner housing body, and a pocket formed on an internal surface of the inner housing body having the penetration hole, the pocket being shaped of a hollow box having an open top surface, one of the pair of lock valves, which is positioned outside the inner housing, being mounted in an inner space of the pocket, and housing mounting grooves being formed on top surfaces of inner and outer partitions of the pocket, respectively, to allow the outer surface of the screw portion disposed between the pair of lock valves and the head portion to be mounted therein.

5. The ice maker of claim 1, wherein the driver comprises:

the drive cam that drives an ice-separating shaft and interlocked with the operation cam;

a drive actuator that actuates the drive cam by providing a one-directional rotating power; and a one-way clutch provided between the drive cam and the drive actuator, the one-way clutch including a driving gear interlocked with the drive cam, one or more idling gears engaged with an internally toothed portion of the driving gear, and a cap inserted into the interior of the internally toothed portion and interlocked with the drive actuator to intermittently effectuate rotation of the one or more idling gears, wherein when the cap is rotated by the drive actuator in one direction, a portion of the cap comes into contact with each of the one or more idling gears to interrupt the rotation of the idling gear and to allow power to be transmitted from the drive actuator to the drive cam, and when the drive cam is rotated by an external force in the opposite direction, the idling gear is engaged with the internally toothed portion and then rotated to block power transmission between the drive actuator and the drive cam.

6. The ice maker of claim 5, wherein the cap includes a cap body shaped of a plate and interlocked with the drive actuator, and an intermittently power-transmitting portion protruding from the cap body and inserted into the interior of the internally toothed portion of the driving gear, the intermittently power-transmitting portion including a cylindrical main body, a cutout portion formed by partially cutting out one side of the main body of the intermittently power-transmitting portion in a radial direction to allow the idling gear to be placed therein, and a wedge portion and an arc portion formed at places where opposite ends of the cutout portion and the main body meet, respectively, the wedge portion being bent at a predetermined angle to be inserted between teeth of the idling gear according to the rotation of the cap body, and a side surface of the arc portion being curved with a predetermined curvature to be spaced a predetermined distance apart from the idling gear so as not to come into contact with the idling gear even when the cap body is rotated, wherein when the intermittently power-transmitting portion is rotated by the drive actuator in one direction, the wedge portion is formed at one side surface of the intermittently power-transmitting portion, the one side surface approaching the idling gear, and the arc portion is formed at the other side surface of the intermittently power-transmitting portion, the other side surface getting far away from the idling gear, and wherein a mounting groove is formed in a portion of the cap body corresponding to a bottom of the cutout portion to allow a portion of the idling gear to be inserted into the mounting groove.

7. The ice maker of claim 6 wherein the main body of the intermittently power-transmitting portion includes a plate-shaped insertion groove concavely formed therein, the cap body includes a locking groove concavely formed at its side surface being opposite to the main body, the locking groove including a penetration hole formed in its bottom, so that the insertion groove and the locking groove are communicated with each other, and the drive actuator includes a driving plate shaped of a plate shape and rotating and a protrusion bar formed at an ending portion of the driving plate, the driving plate being inserted into the insertion groove to be locked, and the protrusion bar being inserted into the penetration hole.

8. The ice maker of claim 5, wherein the driving gear includes a gear body shaped of a hollow cylinder and having a cap side surface opened and an opposite side surface closed and having a penetrating portion formed thereat, an internally toothed portion formed on an inner surface of the gear body, an externally toothed portion formed on an outer surface of the gear body, and a groove portion formed around the penetrating portion in the inner surface of the gear body in a circumferential direction to allow the idling gear to be mounted thereon.

9. The ice maker of claim 5, wherein the idling gear includes a bar-shaped shaft and a toothed portion formed around the bar-shaped shaft to be engaged with the internally toothed portion of the driving gear, the bar-shaped shaft having one side inserted into the groove portion of the driving gear and the other side inserted into the mounting groove of the cap.

10. The ice maker of claim 9, wherein the mounting groove is formed in a circumferential direction of the cap by a predetermined length to allow the idling gear to revolve.

* * * * *